US010578311B2

(12) United States Patent
Briscoe et al.

(10) Patent No.: US 10,578,311 B2
(45) Date of Patent: Mar. 3, 2020

(54) HOME COOKING APPLIANCE HAVING A METERED EXHAUST CHANNEL

(71) Applicants: BSH Home Appliances Corporation, Irvine, CA (US); BSH Hausgeräte GmbH, Munich (DE)

(72) Inventors: Ray Briscoe, Havelock, NC (US); Gayle Collins, New Bern, NC (US); Chris Hoyle, New Bern, NC (US); Brandon Kornegay, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 403 days.

(21) Appl. No.: 15/229,154

(22) Filed: Aug. 5, 2016

(65) Prior Publication Data

US 2018/0038596 A1 Feb. 8, 2018

(51) Int. Cl.
*F24C 15/00* (2006.01)

(52) U.S. Cl.
CPC ..... *F24C 15/006* (2013.01); *F24C 15/001* (2013.01)

(58) Field of Classification Search
CPC .... F24C 15/006; F24C 15/20; F24C 15/2007; F24C 15/2035; F24C 15/001; F24C 15/32; F24C 15/322
See application file for complete search history.

(56) References Cited

U.S. PATENT DOCUMENTS

| | | | | |
|---|---|---|---|---|
| 2,526,890 | A | 10/1950 | Mendel | |
| 3,832,988 | A | 9/1974 | Doner | |
| 6,172,338 | B1 | 1/2001 | Barnes et al. | |
| 2015/0323195 | A1* | 11/2015 | Chadwick | F24C 15/006 126/21 A |
| 2017/0030589 | A1* | 2/2017 | Braden | F24C 15/2007 |
| 2018/0003389 | A1* | 1/2018 | Trice | F24C 3/082 |
| 2018/0038595 | A1* | 2/2018 | Thomas | F24C 15/2007 |

FOREIGN PATENT DOCUMENTS

EP 2463587 A2 * 6/2012 ..... F24C 15/006

OTHER PUBLICATIONS

Rabeeul I. Zuberi, National Search Report, U.S. Appl. No. 14/273,856, dated Jul. 15, 2016.

* cited by examiner

*Primary Examiner* — Alfred Basichas
(74) *Attorney, Agent, or Firm* — Michael E. Tschupp; Andre Pallapies; Brandon G. Braun

(57) ABSTRACT

A home cooking appliance includes a housing having a rear exhaust exit, a cooking surface on top of the housing, the cooking surface having an upper surface, a cooking compartment in the housing, a cooling air system that conveys cooling air through the housing, an exhaust channel in fluid communication with the cooling air system and the rear exhaust exit, the exhaust channel for guiding a portion of the cooling air from the cooling air system to the rear exhaust exit, and an airflow metering device configured to control an airflow of the portion of the cooling air flowing at least one of into the exhaust channel and within the exhaust channel.

21 Claims, 19 Drawing Sheets

100

HOME COOKING APPLIANCE HAVING A METERED EXHAUST CHANNEL

FIELD OF THE INVENTION

The present invention is directed to a home cooking appliance having an exhaust channel in fluid communication with a cooling air system of the appliance, and more particularly, to a home cooking appliance having a metered exhaust channel including one or more airflow metering devices for controlling or limiting airflow into or within the metered exhaust channel.

BACKGROUND OF THE INVENTION

A conventional home cooking appliance, such as a slide-in gas range, includes a housing having a cooking compartment, such as a baking oven, convection oven, steam oven, warming drawer, etc., and a cooking surface formed, for example, by cooking grates disposed over gas burners on top of the housing. A conventional slide-in range is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable temperatures of the combustible back wall behind the appliance, acceptable temperatures of cabinets or components over the range or adjacent to the range, as well as acceptable door temperatures for the appliance, during high temperature events, such as during a self-cleaning cycle of the oven while all burners on the cooktop are on a highest heat setting. The appliance must be able to exhaust cooling air and flue gases from the cooking compartment to maintain acceptable door temperatures for the appliance, acceptable surface temperatures for the appliance, acceptable temperatures of a combustible back wall behind the appliance, and acceptable temperatures of cabinets or components over the range or adjacent to the range.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures and to protect components in and around the appliance, many conventional appliances use costly designs and door construction that increases the air flow through the door and the housing, and/or include raised vent trims on top of the appliance with greater air flow and louder fans. Additionally, conventional home cooking appliances may require a rear wall of the appliance to be spaced from the combustible back wall by a certain amount of clearance in order to manage and dissipate hot air from the appliance in order to improve compliance with the industry standards and regulations.

SUMMARY OF THE INVENTION

The present invention, as illustrated for example in the exemplary embodiments, is directed to a home cooking appliance including a housing having a rear exhaust exit, a cooking surface on top of the housing, the cooking surface having an upper surface, a cooking compartment in the housing, a cooling air system that conveys cooling air through the housing, an exhaust channel in fluid communication with the cooling air system and the rear exhaust exit, the exhaust channel for guiding a portion of the cooling air from the cooling air system to the rear exhaust exit, and an airflow metering device configured to control an airflow of the portion of the cooling air flowing at least one of into the exhaust channel and within the exhaust channel. In this way, the present invention can simply and easily control or limit airflow from the cooling air system into the metered exhaust channel, and/or control the airflow within the metered exhaust channel, thereby affecting air pressure and velocity of the air in the cooling air system upstream of the metered exhaust channel or at locations along the flow path through the metered exhaust channel.

Other features and advantages of the present invention will be described below. To provide a better understanding of the invention, and for further clarification and background of the present invention, various aspects and considerations of a home cooking appliance having an exhaust channel, which have been recognized by the present invention, first will be explained in greater detail.

As explained above, in order to provide enough air flow through the appliance to maintain acceptable surface temperatures and oven door temperatures and to protect components in and around the appliance, many conventional appliances use costly designs and door construction and/or larger, raised vent trims that increases the air flow through the door and the housing with greater air flow and louder fans. This appliance deviates from the conventional designs, which increase a height of the vent above the cooking surface, and instead provides a low-profile rear vent trim that is substantially flush with the cooking surface, which provides a "built-in" appearance that it desirable by many users. Rather than reducing cooktop rates or using larger, raised vent trims on top of the appliance with louder fans in order to comply with testing requirements as in the conventional appliances, the present invention provides one or more rear vent louvers in communication with a cooling air system to more effectively control and manage the air flow around the appliance. By providing one or more rear exhaust louvers on the appliance, and particularly on a rear wall of the appliance, the appliance increases the air pressure along a back wall of the kitchen adjacent to the appliance, thereby providing an air wash along the back wall that impedes or prevents a flow of hot exhaust air, which exits the top of the appliance from other outlets, and hot air from other components such as cooktop burners, from being drawn toward an adjacent back wall of the kitchen, or from being cycled against the adjacent back wall of the kitchen. As a result, these features enable the flow of hot exhaust air exiting the top of the appliance from other outlets to be more freely directed forward and away from the combustible back wall of the kitchen, while simultaneously reducing turbulence above the cooking surface. These features can assist with reducing temperatures, for example during cooktop testing, on components adjacent to the appliance, such as wall cabinets mounted on the back wall of the kitchen either over the cooking surface of the home cooking appliance or over the adjacent floor cabinets, and/or another appliance or component such as an over-the-range (OTR) microwave oven or an OTR convection microwave oven, thereby improving compliance with industry standards and regulations. As a result, the exemplary appliance having the rear exhaust louver and the rear vent trim enables the use of a low-profile rear vent trim having a flush installation with the cooking surface to be used, for example, with a high power cooktop (e.g., 60000 BTU/Hr) having, for example five (5) burners, while complying with industry standards and regulations.

The present invention recognizes that a variety of factors can affect the flow of air outside of, or around, the appliance, and/or within the cooling air system of the appliance, which in turn can affect the temperature at areas of the back wall of the kitchen located behind the appliance, as well as at areas of other components that are adjacent to the appliance, such as wall-mounted kitchen cabinetry or other appliances such as an over-the-range (OTR) microwave during operation of the appliance, which may affect compliance with industry standards and regulations. The present invention further recognizes that appliance manufacturers may benefit from using common parts across several models of appliances, such as for both gas slide-in ranges and dual fuel slide-in ranges, which include a gas cooktop and electric convection oven. For example, the present invention has found that, in some instances, the addition or altering of parts and/or an arrangement of parts of the appliance, such as the use of common side panel parts across different models of appliances, may affect air flow around the appliance in a way that results in changes in temperature of particular areas or regions of the combustible back wall behind the appliance during operation of the appliance, thereby affecting compliance with industry standards and regulations for particular models or types of appliances.

The present invention solves these and other problems by controlling the flow of air within particular areas of the cooling air system of the appliance and/or by controlling the flow of air exhausting from the appliance, thereby controlling the flow of air along the combustible back wall behind the appliance in order to maintain acceptable temperatures of the combustible back wall during operation of the appliance, and thus, maintain compliance with industry standards and regulations. The present invention provides a simple solution for controlling or metering the flow of air (e.g., a velocity and/or pressure of the air) within particular areas of the cooling air system of the appliance and/or for controlling or metering the flow of air (e.g., a velocity and/or pressure of the air) exhausting from particular areas of the appliance that can be simply and easily added to one or more existing parts of the appliance, thereby minimizing modification of existing parts while also allowing common mating parts to be used on multiple types of appliances, such as a gas appliance and dual fuel appliance.

For example, as explained above, an exemplary embodiment of the invention is directed to a home cooking appliance including an exhaust channel in fluid communication with the cooling air system, and an airflow metering device configured to control an airflow of the cooling air into the exhaust channel and/or within the exhaust channel. The airflow metering device can include a metering flange extending from the exhaust channel or an adjacent part, thereby reducing an area of an entry opening of the exhaust channel or an area of the exhaust channel downstream of the entry opening of the exhaust channel. The airflow metering device can be configured to increase air pressure (e.g., back pressure) in areas of the cooling system upstream of the exhaust channel and decrease air pressure in the exhaust channel or in areas downstream of the exhaust channel. In this way, the airflow metering device can increase a velocity of cooling air exiting a rear louver (or a plurality of rear louvers) upstream of the exhaust channel (e.g., at a central location of the rear wall of the appliance and back wall behind the appliance) while decreasing a velocity of cooling air exiting a rear louver (or a plurality of rear louvers) along, or downstream of, the exhaust channel (e.g., at locations of the rear wall of the appliance and back wall behind the appliance between the center of the back wall and the sides of the back wall of the appliance). The airflow metering device also may increase a volume of cooling air exiting the rear louver (or a plurality of rear louvers) upstream of the exhaust channel (e.g., at a central location of the rear wall of the appliance and back wall behind the appliance) while decreasing a volume of cooling air exiting the rear louver (or a plurality of rear louvers) along, or downstream of, the exhaust channel (e.g., at locations of the rear wall of the appliance and back wall behind the appliance between the center of the back wall and the sides of the back wall of the appliance). The rear exhaust louvers direct the air being exhausted from the appliance in an upward direction along the areas of the rear wall and substantially in a plane of the rear wall such that the air flows upward beyond the top of the appliance to increase the air pressure along the back wall of the kitchen and create an air wash that impedes the flow of the air (as well as flue gases and other heated air from the cooktops) from flowing or being drawn toward the back wall of the kitchen, to thereby maintain temperatures of the back wall in compliance with industry standards and regulations.

The metered exhaust channel can be configured to have a Poke Yoke design in which the exhaust channel can be installed on the appliance in only a single orientation, thereby reducing or eliminating assembly errors. The exhaust channel can be configured to be universally installed on either side of the appliance (e.g., left of center or right of center), thereby eliminating the need for specific parts for either side of the appliance. For example, the exhaust channel can include a plurality airflow metering devices that are symmetrically disposed (e.g., disposed at both ends of the exhaust channel) such that a common exhaust channel can be provided that is configured to be universally installed on either side of the appliance, thereby eliminating the need for specific parts for either side of the appliance and reducing manufacturing costs and complexity.

The features of the present invention can be provided separately, or in combination with each other or in combination with other features of a home cooking appliance for managing and dissipating the hot air being exhausted from the appliance, thereby further improving compliance with industry standards and regulations.

The features of the present invention are not limited to any particular type of cooking appliance or to a cooking appliance having any particular arrangement of features. For example, one of ordinary skill in the art will recognize that the features of the present invention are not limited to a slide-in gas cooking appliance, and can include, for example, a built-in cooking appliance such as a gas range or gas oven, an electric range or oven, or another cooking appliance that will benefit from distributing the hot air being exhausted from the appliance around the appliance, thereby minimizing temperatures on the combustible back wall of the kitchen or another component, and improving compliance with industry standards and regulations.

For purposes of this disclosure, the term "back wall" refers to a combustible wall of a kitchen that faces a rear wall of the appliance when the appliance is in an installed position.

For purposes of this disclosure, an upper surface of the rear vent trim is substantially flush with an upper surface of the cooking surface if the upper surface of the rear vent trim is approximately level with the upper surface of the cooking surface, or for example, if at least the front edge or rear edge of the upper surface of the rear vent trim is approximately level with the upper surface of the cooking surface, or for example, if at least a part of the upper surface of the rear vent trim is approximately level with the upper surface of the cooking surface. One of ordinary skill in the art will recognize that the upper surface of the rear vent trim, or any part thereof, does not need to be exactly the same height as the upper surface of the cooking surface for the upper surface of the rear vent trim to be substantially flush with the upper surface of the cooking surface.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
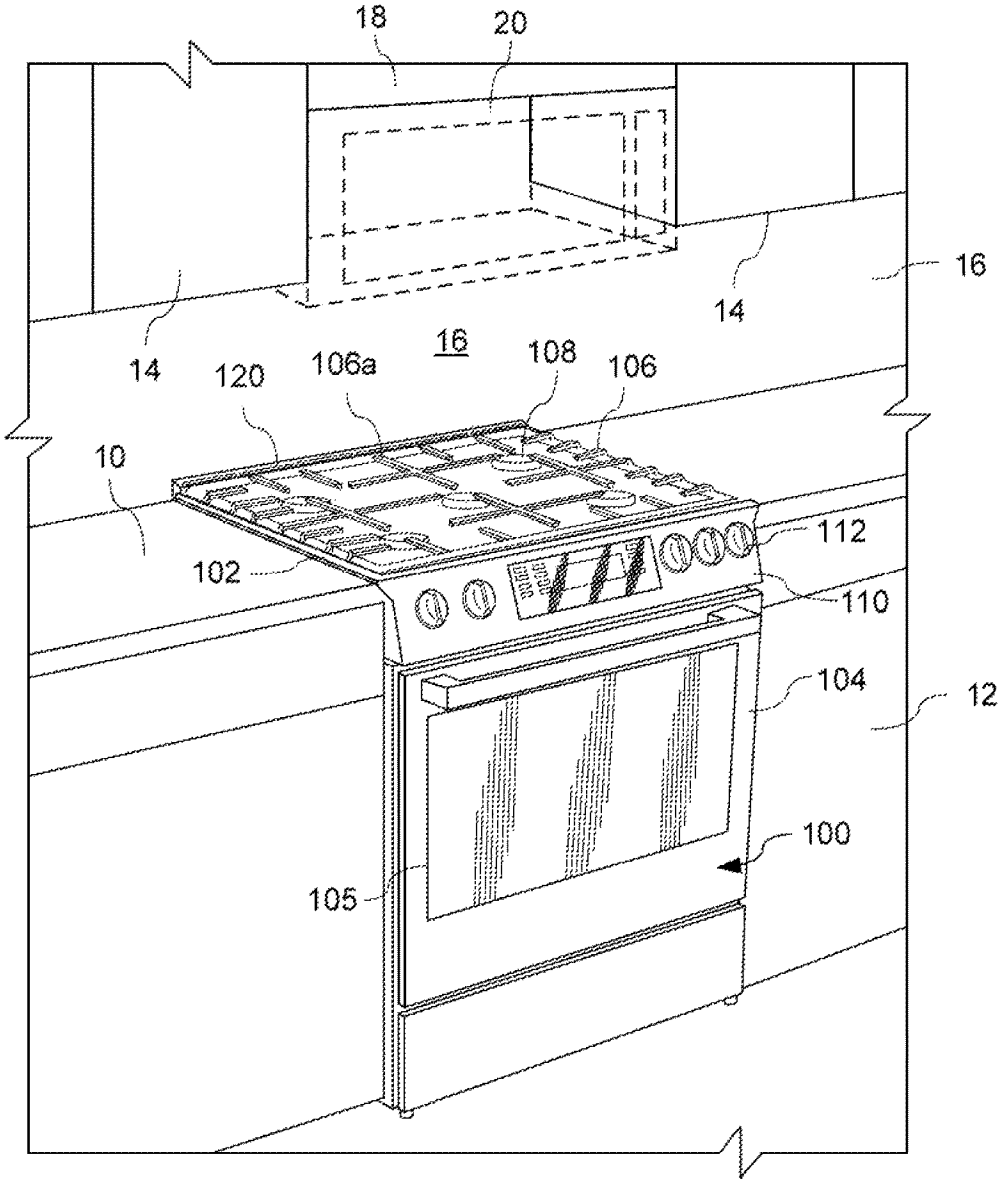
FIG. 1 is a front perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-10 illustrate exemplary embodiments of a home cooking appliance having metered exhaust channels in fluid communication with a cooling air system and exhausting a portion of air from the housing of the appliance in an upward direction at the rear of the appliance.

As illustrated in FIG. 1, a cooking area of a home kitchen may include counters 10 with floor cabinets 12 below the counters 10. The kitchen can include wall cabinets 14 on back wall 16 (e.g., a combustible back wall). A home cooking appliance 100, such as a slide-in home cooking appliance, can be disposed between the floor cabinets 12 and counters 10. A wall cabinet 18 or an over-the-range (OTR) microwave oven or convention microwave oven 20 can be disposed over the cooking surface 106 of the home cooking appliance 100.

With reference again to FIG. 1 and also to FIGS. 2-4B, an exemplary embodiment of a home cooking appliance 100, a cooling air system of the appliance 100, and operation thereof, will first be described. The home cooking appliance 100 has a housing 102 with a cooking compartment, such as a baking oven, convection oven, steam oven, warming drawer, etc., in the housing 102 and accessible through a door 104 in a front of the housing 102. The door 104 has a door glass 105. The home cooking appliance 100 has a cooking surface 106 on a top of the housing 102. The cooking surface 106 can include one or more cooking grates having an upper surface 106*a* for supporting cookware over one or more gas burners 108. The appliance 100 includes a control panel 110 having a plurality of control knobs 112 for controlling the operation of the burners 108 and the cooking compartment.

As shown in FIG. 1, the home cooking appliance 100 can be configured as a slide-in range that fits flush to adjacent cabinetry for a seamless, built-in look. The housing 102 can include a rear vent trim 120 on the top of the housing 102 and at a rear side of the cooking surface 106. In an exemplary embodiment, the rear vent trim 120 can include an upper surface that is substantially flush with the upper surface 106*a* of the rear end of the cooking surface 110, thereby maximizing the cooking area of the appliance and providing a low-profile appearance. The rear vent trim 120 includes one or more openings (which will be explained in greater detail below) for permitting air to exit from within the rear vent trim 120 while directing the air away from the back wall 16 (e.g., away from a 90° angle with respect to the upper surface of the cooking surface). The rear vent trim 120 (and particularly the openings in the rear vent trim) can be arranged in fluid communication with a cavity or duct for exhausting kitchen air up and away from the back wall 16, a cavity or duct for exhausting at least a portion of cooling air circulated or passed through the appliance (e.g., through the housing 102 and/or door 104 of the appliance 100), and/or one or more flues for exhausting flue gas from the cooking compartment (each of which will be explained in greater detail below). The rear vent trim 120 controls and manages the air flow by directing the flow of air from the rear vent trim 120 forward and away from a combustible back wall 16 of the kitchen (e.g., away from a 90° angle with respect to the upper surface of the cooking surface), thereby minimizing temperatures on the combustible back wall 16 of the kitchen and improving compliance with industry standards and regulations.

Figure 2:
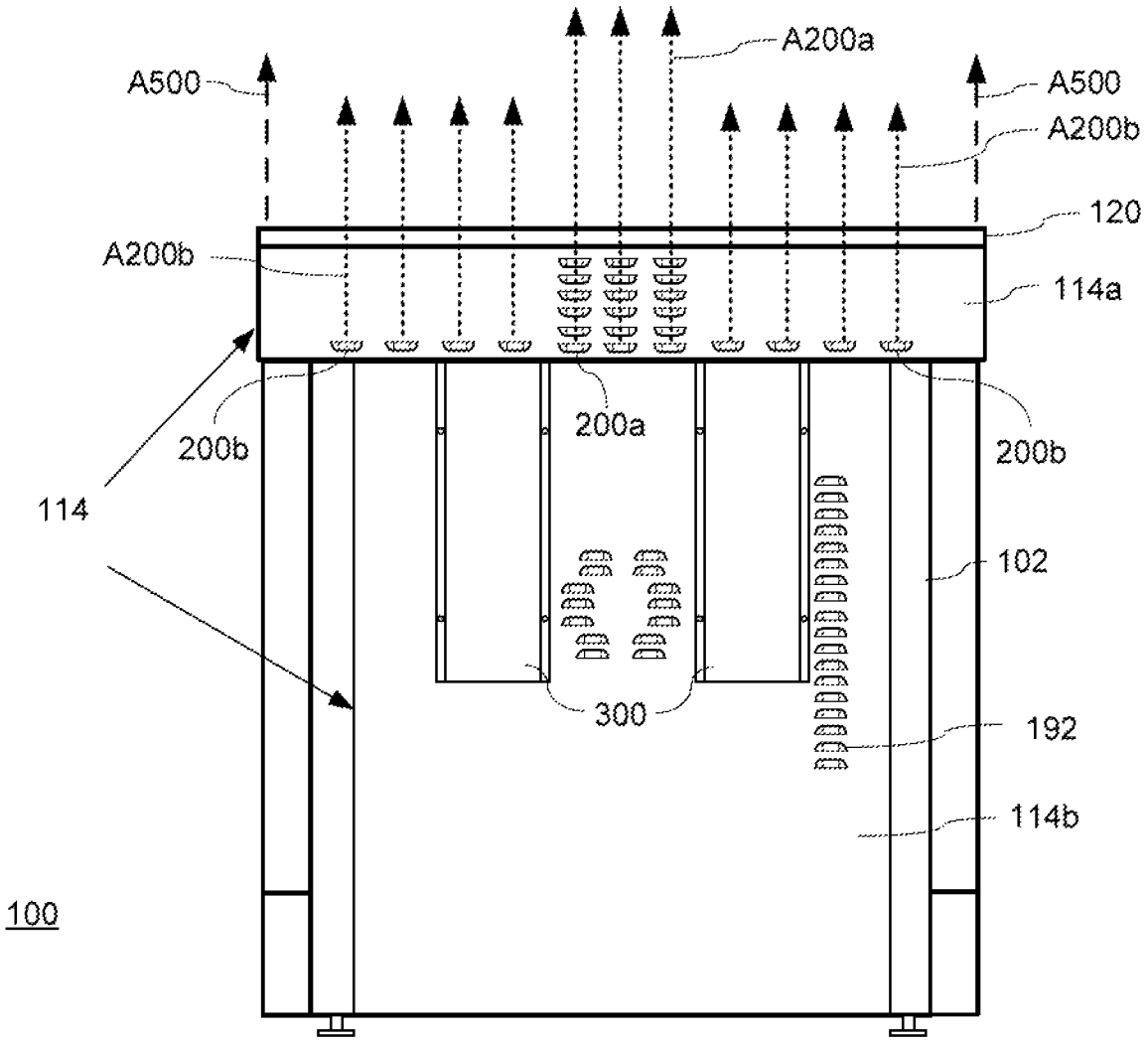
FIG. 2 is a rear view of a home cooking appliance according to an exemplary embodiment of the invention and schematically illustrating air flow patterns.
Figure 3:
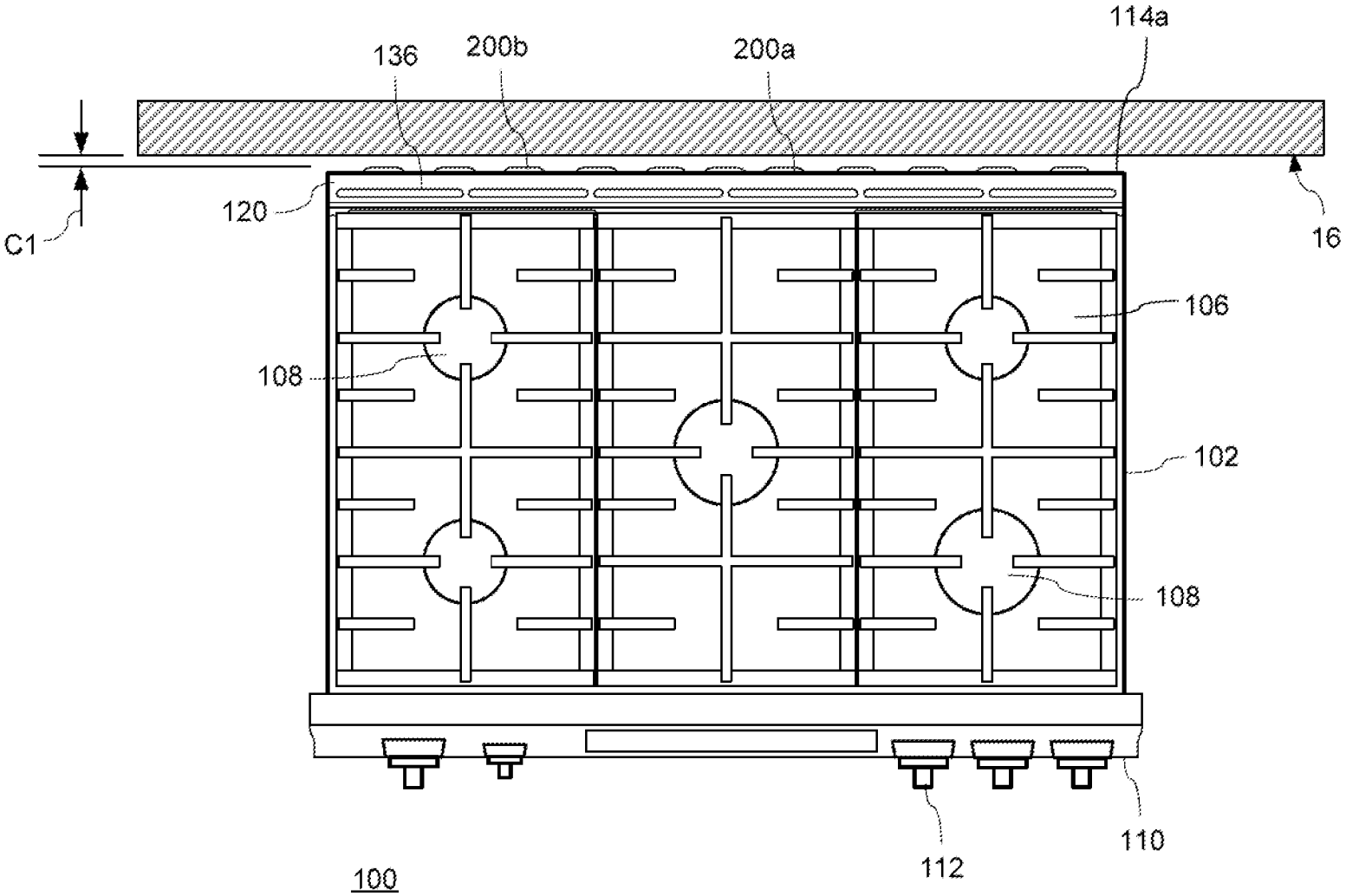
FIG. 3 is a top view of a home cooking appliance according to an exemplary embodiment of the invention.

With reference to FIGS. 2 and 3, the appliance 100 can include a housing 102 with a rear wall (114*a*, 114*b*) that faces the back wall of the kitchen when the appliance 100 is in an installed position. In this example, the rear wall includes a first rear wall portion 114*a* at the rear side of the cooktop, and a second rear wall portion 114*b* at the rear side of the cooking chamber and below the first rear wall portion 114*a*. The first rear wall portion 114*a* and the second rear wall portion 114*b* can be coplanar with each other, or offset from each other. For example, in the illustrated example, the first rear wall portion 114*a* can be disposed further rearward (i.e., offset in a direction to the rear) from the second rear wall portion 114*b* as shown in FIG. 2. For purposes of this disclosure, the first and second rear wall portions 114*a*, 114*b* will be referred to generally as the rear wall when referencing features on each respective surface.

The housing 102 includes a rear vent trim 120 arranged at a rear side of the top of the appliance 100. The rear vent trim 120 includes a plurality of openings (not visible in FIG. 2) for exhausting air (e.g., air from the cooling air system, flue gases, etc.) from within the housing 102 while directing the air away from the back wall of the kitchen (e.g., away from a 90° angle with respect to the upper surface of the cooking surface). The appliance 100 can include one or more fan channels 300, for example on the rear wall 114*a* and/or 114*b*, for drawing air into the cooling air system from areas outside of the appliance 100, such as from areas of lower temperature behind the appliance 100. The cooler air being drawn into the fan channels 300 can reduce the temperature of the air being exhausted in the upward direction from the rear exhaust louvers 200*a*, 200*b*. The appliance 100 can include one or more inlets or openings 192, for example in the rear wall 114*a* and/or 114*b*, for drawing kitchen air into the appliance 100 to cool electrical components or other components.

The appliance 100 can include one or more rear exhaust louvers 200*a*, 200*b* in fluid communication with a cooling air system of the appliance 100. The arrangement of the cooling air system will be explained in greater detail with reference to FIGS. 4A and 4B. The rear exhaust louvers 200*a*, 200*b* can be configured to exhaust a portion of the air A200*a*, A200*b* from the cooling air system out of the housing 102 in an upward direction substantially in a plane of the rear wall (e.g., 114*a* in the example) of the housing 102 to increase air pressure along a kitchen wall adjacent to the rear wall 114*a* of the appliance 100. The upward direction can be a substantially vertical upward direction (e.g., substantially 90°) at the exit of the rear exhaust louver 200*a*, 200*b*, as shown in FIG. 2. In other embodiments, the rear exhaust louvers 200*a*, 200*b* can be configured to exhaust a portion of the air A200 of the cooling air system from the housing 102 in an upward direction that is not vertical (e.g., at an angle that is greater than 0° and less than 90°) at the exit of the rear exhaust louver 200*a*, 200*b*.

The appliance 100 includes one or more corner exhaust channels (not visible in FIG. 2) that exhaust air A500 (illustrated in FIG. 2) from the cooling air system from openings at the corners of the rear vent trim 120. In this example, the air A500 is exhausted in an upward direction from openings in the rear vent trim 120 at the corners of the appliance, thereby creating a high pressure area or air stream of the air A500 at each corner of the appliance 100 to impede the flow of hot air toward the corners of the appliance.

FIG. 3 illustrates an exemplary embodiment of an appliance having a plurality of rear exhaust louvers 200*a*, 200*b* in an installed position adjacent to a back wall 16 of a kitchen. As will be explained in greater detail below, the rear exhaust louvers 200*a*, 200*b* and the rear vent trim 120 cooperate to control and manage the air flow above the cooking surface 106, thereby minimizing temperatures on the combustible back wall 16 of the kitchen and improving compliance with industry standards and regulations, while also maintaining passing combustion results at the gas burners 108 and the cooking compartment, minimizing noise to the user, and providing a low profile, rear vent trim 120 that is substantially flush with cooking grates 106 of the home cooking appliance 100. As a result, the present invention can minimize, or some in cases, eliminate a required minimum clearance C1 between the rear wall 114*a* of the appliance 100 and a combustible back wall 16 of the kitchen, which faces the rear wall 114*a* of the appliance, while maintaining compliance with industry standards and regulations. In an exemplary embodiment, the rear exhaust louvers 200*a*, 200*b* and the rear vent trim 120 control and manage the air flow to such an extent that very little spacing is needed between the rear wall of the appliance and the combustible back wall 16 of the kitchen in order to maintain compliance with industry standards and regulations, and therefore, the rear wall of the appliance can be moved into close proximity with the combustible back wall 16 of the kitchen, thereby maximizing the use of space in the kitchen and further improving the "built-in" appearance of the appliance. In another exemplary embodiment, the rear exhaust louvers 200*a*, 200*b* and the rear vent trim 120 control and manage the air flow to such an extent that any need for a required clearance between the rear wall 114*a* and the combustible back wall 16 of the kitchen can be entirely eliminated, thereby permitting the rear wall 114*a* (or at least the rear exhaust louvers 200*a*, 200*b* on the rear wall 114*a*) of the appliance to directly abut or contact the combustible back wall 16 of the kitchen, while maintaining compliance with industry standards and regulations.

Figure 4A:
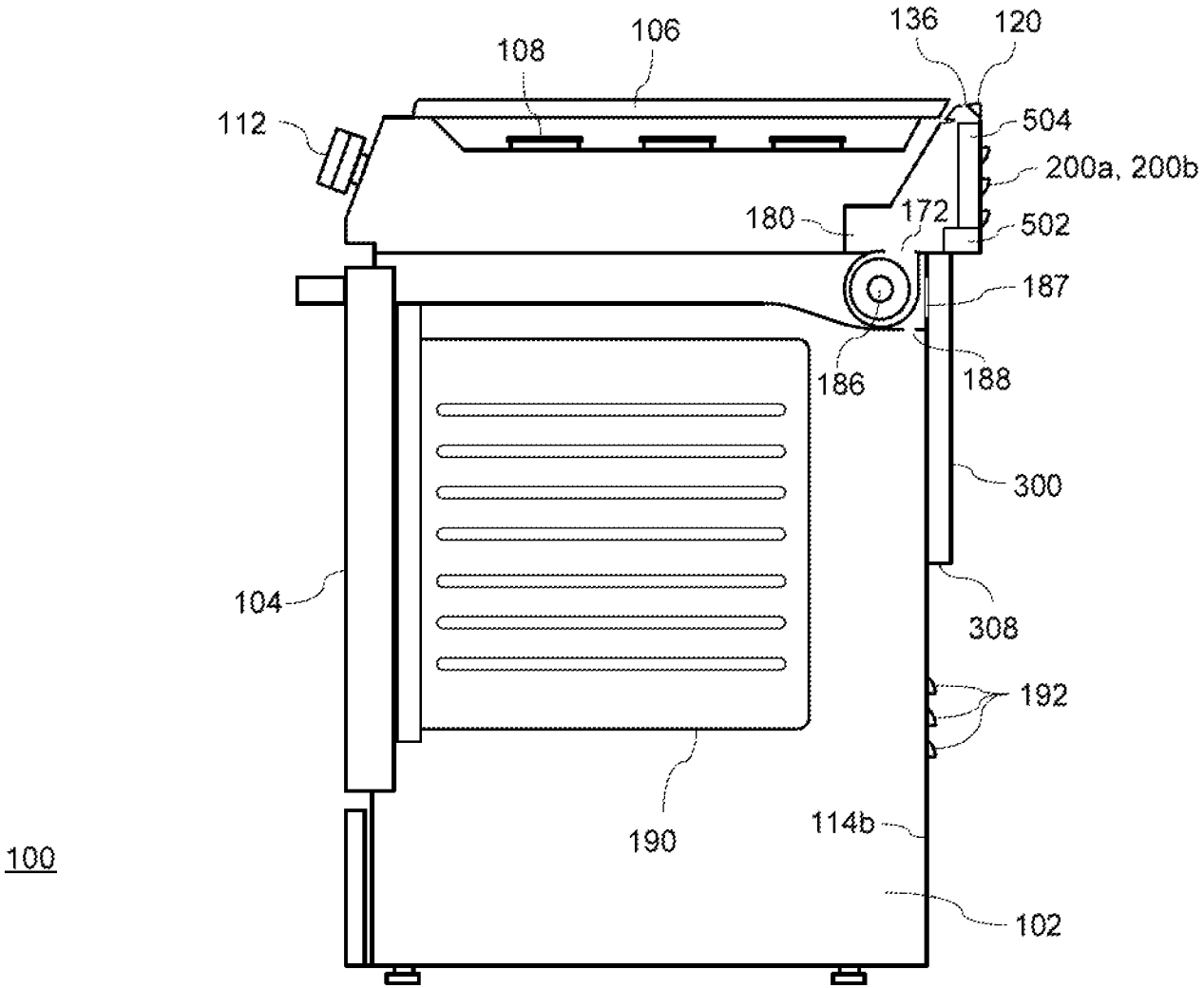
FIG. 4A is a schematic side view of a home cooking appliance according to an exemplary embodiment of the invention.
Figure 4B:
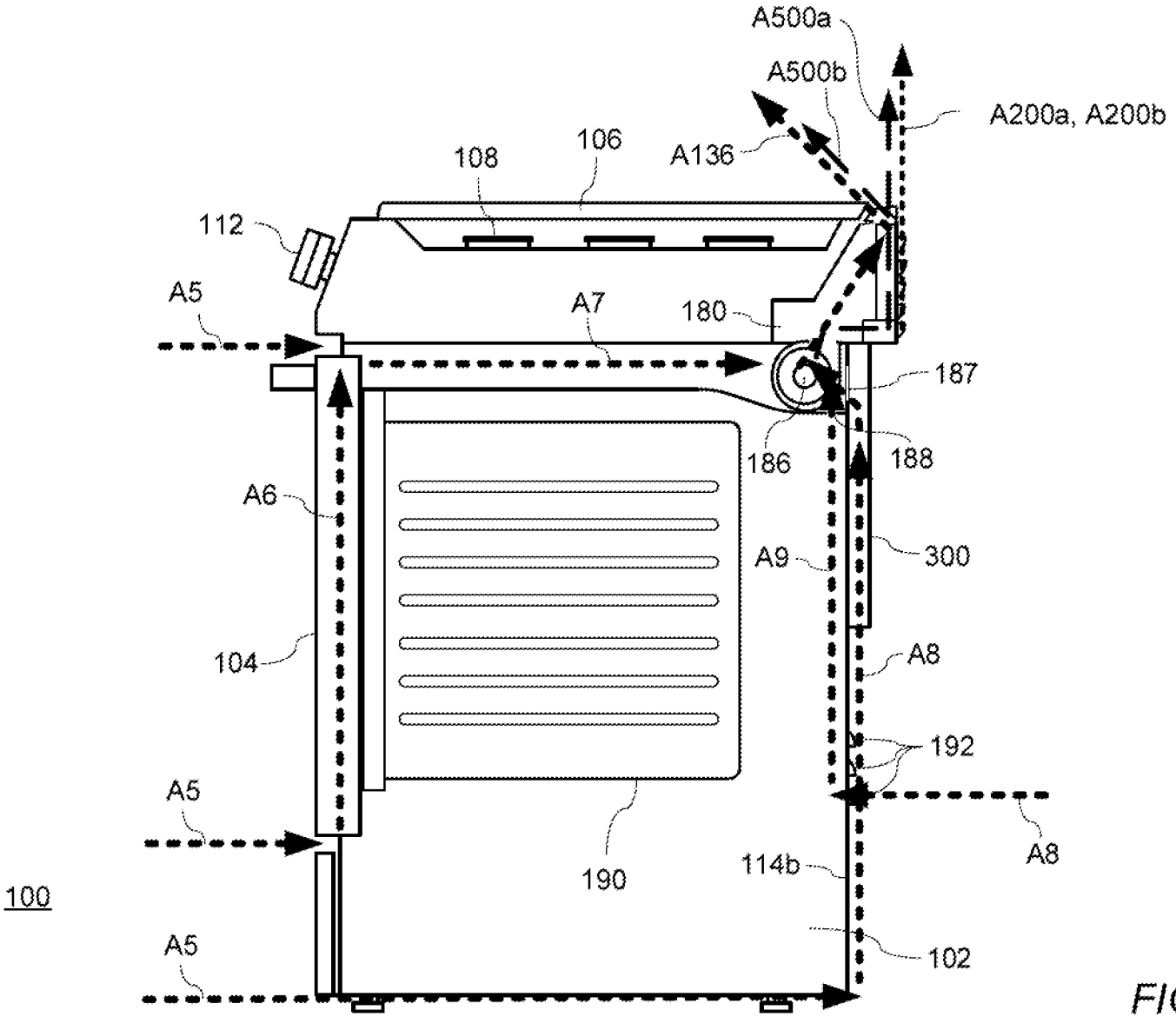
FIG. 4B is a schematic side view of the home cooking appliance according to the exemplary embodiment of the invention in FIG. 4A illustrating air flow paths through the rear vent trim and rear exhaust louvers.

FIGS. 4A and 4B schematically illustrate a cooling air system and the flow of the cooling air through the cooling air system of an exemplary embodiment of a home cooking appliance. The appliance 100 includes a housing 102 having a cooking compartment 190 accessible through a door 104, cooktop burners 108, and a control panel 110 having a plurality of control knobs 112 for controlling the operation of the burners 108 and the cooking compartment 190. The appliance 100 includes a substantially flush, low-profile rear vent trim 120 arranged at a rear side of the top of the appliance 100. The rear vent trim 120 includes openings 136 in fluid communication with a cavity or duct 180 for exhausting a portion of the cooling air circulated or passed through the appliance (e.g., through the housing 102 and/or door 104 of the appliance 100) by a fan 186. The housing 102 includes a first rear wall portion 114*a* having a plurality of rear exhaust louvers 200 in fluid communication with the cavity 180. The housing includes a second rear wall portion 114*b* having a plurality of intake vents 192 in fluid communication with an interior of the housing 102. The intake vents 192 can be positioned at any location on the housing 102, such as adjacent to various electronic components, etc., in order to cool such components. In addition to or alternative to the intake vents 192, the rear wall 114*b* can include a rear fan channel 300 in fluid communication with an interior of the housing 102. The rear fan channel 300 can include a first end in fluid communication with the kitchen air and a second end in fluid communication with the cooling air system of the appliance. The rear fan channel 300 can be on an exterior surface of the rear wall 114*b* of the housing 102. The rear fan channel 300 can be coupled to the rear wall 114*b* or integrally formed with the rear wall 114*b*. In other embodiments (not shown), the rear fan channel 300 can be disposed inside the housing 102 with respect to the rear wall 114*b* with an inlet of the rear fan channel 300 formed in or on the rear wall 114*b* and open to the exterior of the housing 102. All or a portion of the rear fan channel 300 can extend in a downward direction (e.g., vertically or at an angle) along the rear wall 114*b* of the housing 102.

As will be described in greater detail below, the appliance 100 includes one or more metered exhaust channels or tubes 502 configured to guide a portion of the cooling air to one or more of the rear exhaust louvers 200 located toward the sides of the appliance. The metered exhaust channels 502 also can guide a portion of the cooling air toward the sides of the appliance and into one or more corner exhaust channels 504 located at the corners of the appliance such that the air can be exhausted from the cooling air system from openings 136 in the rear vent trim 120, which are disposed over the corner exhaust channels 504 at the corners of the appliance 100 to impede the flow of hot air toward the corners of the appliance.

As shown in FIG. 4B, in operation, the fan 186 draws cool ambient kitchen air A5 into the housing 102 and/or door 104 of the appliance 100. The cooling air flows through the door 104 along flow path A6 and through the housing 102 along flow path A7 such that heat from the cooking compartment 190 and other components of the appliance is transferred to the cooling air and conveyed away in order to cool the cooking compartment and other components of the appliance 100. The fan 186 draws the air through the appliance and then pushes the heated air through the opening 172 into the cavity 180. The fan 186 also can draw air from other areas of the appliance, such as from areas within the appliance housing 102 that house electronics or other components. For example, the fan 186 can be in fluid communication with internal areas within the housing 102 via an opening 188 to permit heated air A9 to be drawn from these areas and exhausted from the appliance in order to cool other components, such as electronics. In operation, the fan 186 draws kitchen air A8 into the housing 102, for example, through one or more intake vents 192 in the housing 102, which may be located in proximity to electrical components or the like, such that the air flows along flow path A9 through one or more openings 188 and into the cavity 180 by the fan 186.

The fan 186 produces a high pressure in the cavity 180 that forces a portion of the heated air A136 out of the openings 136 of the rear vent trim 120. The rear vent trim 120 can include one or more deflectors to direct the air A136 exiting the openings 136 away from the back wall of the kitchen (e.g., away from a 90° angle with respect to the upper surface of the cooking surface 106), and more particularly, in a forward direction above the cooking grates 106 of the cooktop such that the air A136 does not disrupt the burner flame even when a burner 108 is on a lowest setting. The high pressure in the cavity 180 also forces a portion of the heated air A200*a*, A200*b* out of the rear exhaust louvers 200*a*, 200*b* of the rear wall 114*a*. The rear exhaust louvers 200*a*, 200*b* direct the air A200*a*, A200*b* in an upward direction along the rear wall 114*a* and substantially in a plane of the rear wall 114*a* such that the air A200*a*, A200*b* flows upward beyond the top of the appliance to increase the air pressure along the back wall of the kitchen and create an air wash that impedes the flow of the air A136 (as well as the flue gases and other heated air from the cooktops) from flowing or being drawn toward the back wall of the kitchen. As mentioned, the metered exhaust channels 502 guide a portion of the cooling air to one or more of the rear exhaust louvers 200*b* located toward the sides of the appliance. In this example, the metered exhaust channels 502 also guide a portion of the cooling air into corner exhaust channels 504 located at the corners of the appliance such that the air A500*a*, A500*b* can be exhausted from the cooling air system from openings 136 in the rear vent trim 120, which are disposed over the corner exhaust channels 504 at the corners of the appliance 100, to impede the flow of hot air toward the corners of the appliance. The air exhausting from the corner exhaust channels 504 can be directed or split into more than one air stream or direction. For example, in the illustrated embodiment, a first portion of the air A500*a* is exhausted in an upward direction to, for example, an opening in the rear vent trim such that the air A500*a* flows in an upward direction from the corners of the appliance. A second portion of the air A500*b* is directed in a forward direction away from the back wall 16 of the kitchen (e.g., away from a 90° angle with respect to the upper surface of the cooking surface 106).

FIGS. 5A-5D illustrate an exemplary embodiment of a home cooking appliance in which the cooking surface 106, the cooktop drip tray, and several of the burners 108 have been omitted to show the arrangement of the components of the appliance and to more clearly show the air flow paths within the appliance that flow from the opening 172 to the rear exhaust louvers 200*a*, 200*b*, the metered exhaust channel 502, the corner exhaust channels 504 (if included), and the openings 132, 134, and 136 of the rear vent trim 120. The rear panel 400 has been omitted in FIGS. 5C and 5D to show the arrangement of the components of the appliance and to more clearly show the air flow paths within the appliance that flow to the metered exhaust channel 502, the corner exhaust channels 504, and the openings 132, 134, and 136 of the rear vent trim 120.

Figure 5A:
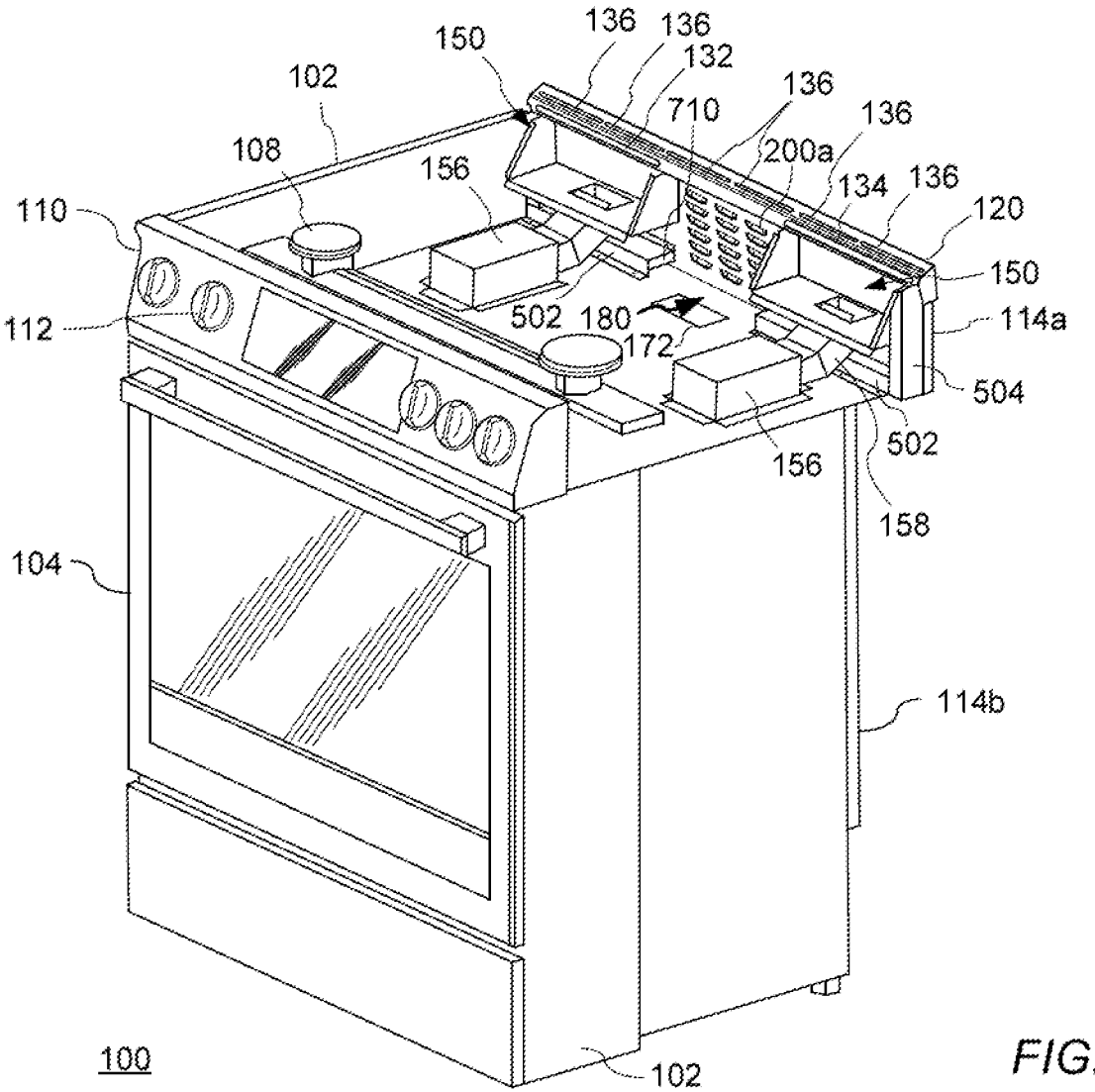
FIG. 5A is a schematic, cut-away front perspective view of a home cooking appliance according to an exemplary embodiment of the invention.
Figure 5B:
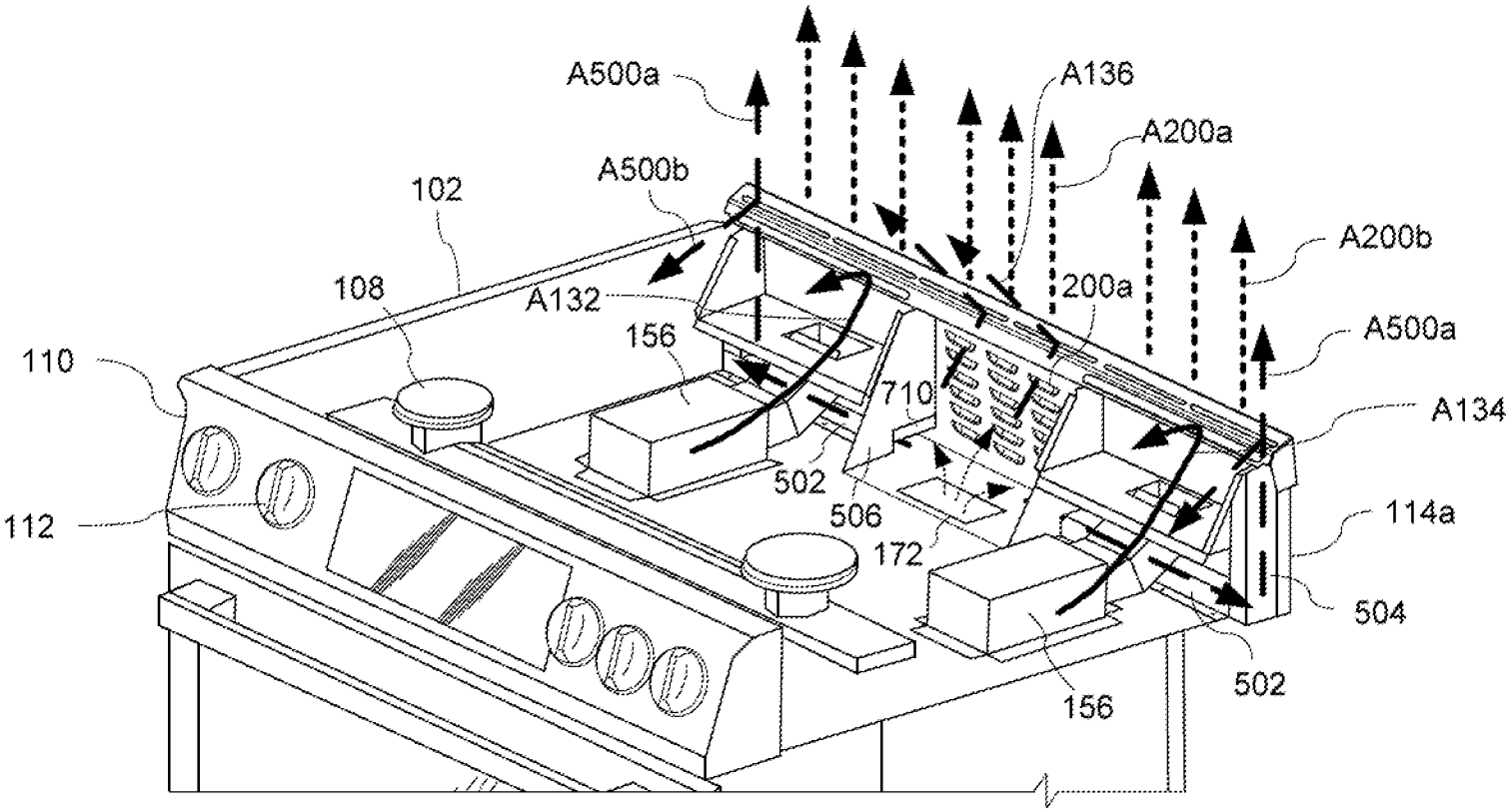
FIG. 5B is a partial, schematic, cut-away front perspective view of the home cooking appliance illustrated in FIG. 5A showing air flow paths.

In the example illustrated in FIGS. 5A and 5B, the cooking compartment has a dual flue arrangement having flues 156, each of which exhausts flue gases from the cooking compartment through a flue duct 158 and into a flue boundary 150. During operation of the appliance 100, the flue gases A132, A134 from the cooking compartment flow through the flues 156 and flue ducts 158 into the flue boundaries 150, where the flue gases A132, A134 are then exhausted from the appliance 100 via the openings 132, 134 in the rear vent trim 120. The rear vent trim 120 can be configured to exhaust the flue gases A132, A134 from the openings 132, 134 in the rear vent trim 120 while directing the flue gases A132, A134 away from the back wall of the kitchen (e.g., away from a 90° angle with respect to the upper surface of the cooking surface). In the illustrated example, the rear vent trim 120 is configured to direct the flue gases A132, A134 away from the back wall of the kitchen (e.g., away from a 90° angle with respect to the upper surface of the cooking surface), and more particularly, in a forward direction under the cooking grates of the cooktop. In an exemplary embodiment, the cooking surface (e.g., cooking grate 106 shown in FIGS. 1 and 3) can include one or more slots (e.g., grate slots) corresponding to one or more of the openings 132, 134 and formed in a lower side of a part of the cooking surface to permit the air A132 exiting from the respective openings 132, 134 to pass under the cooking surface, for example, with minimal or no interference or disruption to the air flow.

Figure 5D:
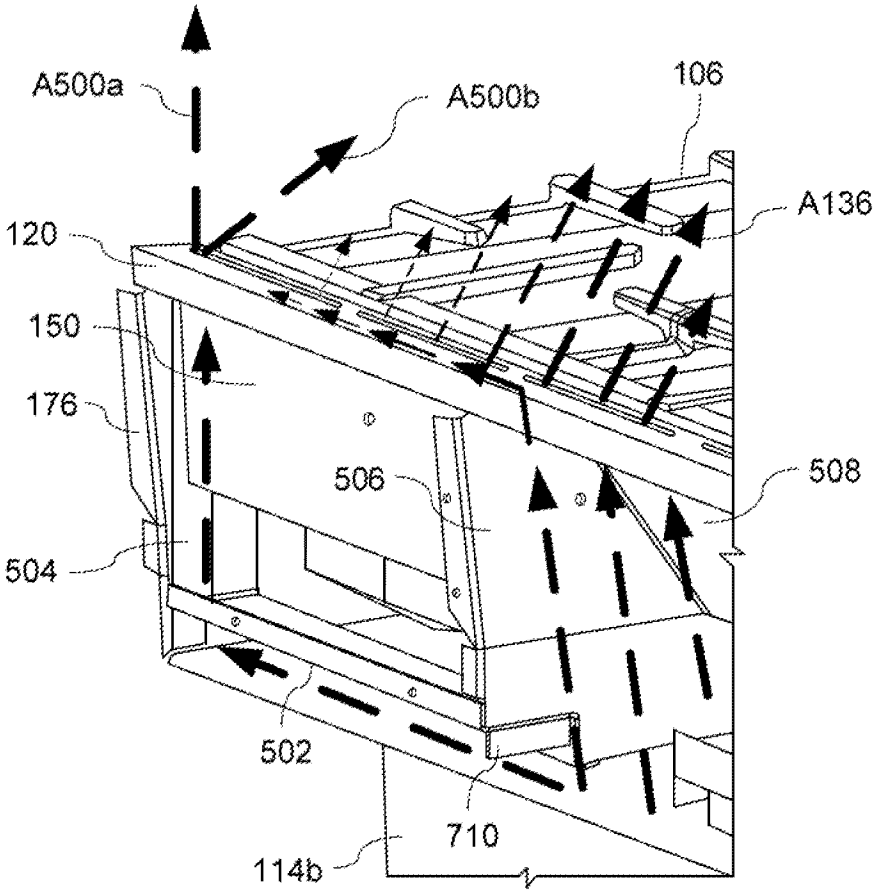
FIG. 5D is a partial, schematic, cut-away rear perspective view of the home cooking appliance illustrated in FIG. 5A showing air flow paths.
Figure 5C:
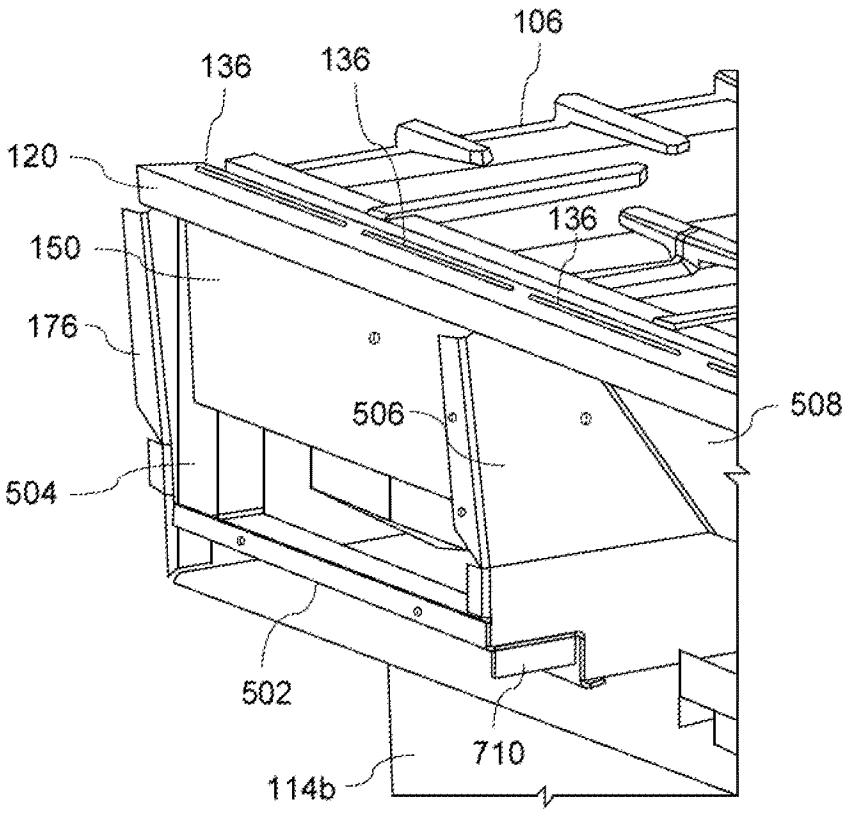
FIG. 5C is a partial, schematic, cut-away rear perspective view of the home cooking appliance illustrated in FIG. 5A.

As shown in FIGS. 5A-5D, the mid-plenum, cavity, or duct 180 includes sidewalls 506 and a front wall 508 (shown in FIGS. 5C and 5D; omitted in FIGS. 5A and 5B for clarity). In this example, the rear wall 114*a* forms a rear wall of the cavity 180, and includes the plurality of rear exhaust louvers 200*a*, 200*b* configured to exhaust air from the appliance in an upward direction substantially in a plane of the rear wall 114*a*. The rear vent trim 120 includes openings 136 arranged in fluid communication with the cavity 180 for exhausting a portion of the cooling air A136 from the appliance. In the illustrated example, the openings 136 in the rear vent trim 120 are configured to direct the air A136 away from the back wall of the kitchen (e.g., away from a 90° angle with respect to the upper surface of the cooking surface), and more particularly, in a forward direction above the cooking grates of the cooktop.

The appliance 100 includes one or more metered exhaust channels 502 for permitting the cooling air to flow from the cavity 180 to the rear exhaust louvers 200*b* at other locations on the rear wall 114*a* away from the cavity 180. The metered exhaust channels 502 are spaced from other components, such as the flue boundaries, flue ducts, etc., to minimize or prevent heat transfer from high temperature components to the cooling air. As will be explained in greater detail below, the metered exhaust channel 502 can include one or more airflow metering devices (e.g., one or more metered flanges 710 in FIGS. 5A-5D) for controlling or limiting airflow along the flow path, affecting air pressure and velocity of the air at locations along the flow path, and affecting air pressure and velocity of the air A200*a*, A200*b* exiting the rear exhaust louvers 200*a*, 200*b*. The appliance 100 can include one or more corner exhaust channels 504 for permitting a portion A500*a* of the cooling air to flow from the metered exhaust channels 502 to one or more of the openings 136 located at the sides of the rear vent trim 120. In the illustrated example, the rear vent trim 120 is configured to direct a first portion of air A500*a* in an upward direction (e.g., vertically) and a second portion of air A500*b* in a forward direction away from the back wall of the kitchen and above the cooking grates of the cooktop (e.g., away from a 90° angle with respect to the upper surface of the cooking surface). However, other air flow arrangements are possible.

In operation, the cooling fan 186 circulates cooling air through the appliance (e.g., through the housing 102 and/or door 104 of the appliance 100) to cool the cooking compartment and other components of the appliance and forces the cooling air into the cavity 180 via the opening 172 and pressurizes the cooling air in the cavity 180. The cooling air can exit the openings 136 in the rear vent trim 120 and the rear exhaust louvers 200*a*, 200*b*. Owing to the high pressure in the cavity 180, a portion A200*a* of the cooling air in the cavity 180 is pushed out of the rear wall 114*a* of the appliance through the rear exhaust louvers 200*a*. A portion A200*b* of the cooling air is forced from the cavity 180 into the metered exhaust channels 502, which guide the air to additional rear exhaust louvers 200*b*, such that air A200*b* exits from the additional louvers 200*b*. The metered exhaust channel 502 can include one or more airflow metering devices (e.g., one or more metered flanges e.g., 710) for controlling or limiting airflow from the cavity 180 into the metered exhaust channel 502, or for controlling the airflow within the metered exhaust channel 502. The one or more airflow metering devices (e.g., 710) can affect air pressure and velocity of the air in the cavity 180 or at locations along the metered exhaust channel 502. For example, the airflow metering devices can be formed by a metering flange 710 extending at least partially into the opening between the cavity 180 and the metered exhaust channel 502 by a predetermined amount, thereby reducing an area of the opening between the cavity 180 and the metered exhaust channel 502 and resulting in an increase in back pressure in the cavity 180, and affecting the velocity of the air A200*a*, A200*b* exiting the rear exhaust louvers 200*a* from the cavity 180. In this way, the metering flange 710 can be configured to affect or control (e.g., increase) a pressure in the metered exhaust channel 502, and control (e.g., increase) a velocity of the air A200*a* exiting the rear exhaust louvers 200*a* from the cavity 180. The one or more metering flanges 710 also can affect or control (e.g., decrease) a pressure in the metered exhaust channel 502, and control (e.g., decrease) a velocity of the air A200*b* exiting the rear exhaust louvers 200*b* from the metered exhaust channel 502. The one or more metering flanges 710 also can affect or control (e.g., decrease) a pressure in the optional corner exhaust channel 504, if so quipped, and control (e.g., decrease) a velocity of the air A500*a*, A500*b* exiting the rear vent trim 120 from the corner exhaust channel 504.

With reference again to FIGS. 2-5D, the appliance 100 provides a plurality of hot air extraction points on different locations 120, 200*a*, 200*b* of the appliance by dividing or separating the air flow from the cooling air system between the rear vent trim 120 (on top of the appliance) and the rear exhaust louvers 200*a*, 200*b* (on the rear wall of the appliance). The rear exhaust louvers 200*a*, 200*b* can provide several functions. For example, the rear exhaust louvers 200*a*, 200*b* direct the air A200*a*, A200*b* in an upward direction along the rear wall 114*a* and substantially in a plane of the rear wall 114*a* such that the air A200*a*, A200*b* flows upward beyond the top of the appliance to increase the air pressure along the back wall of the kitchen and create an air wash that impedes the flow of the air A136 (as well as flue gases and other heated air from the cooktops) from flowing or being drawn toward the back wall of the kitchen. The rear exhaust louvers 200*a*, 200*b* also depressurize the airflow in the cooling air system and direct a portion A200*a*, A200*b* of the airflow out of the rear wall 114*a* of the appliance 100, thereby increasing the volume of air that can flow through the cooling air system and reducing back pressure in the cavity 180. The rear exhaust louvers 200*a*, 200*b* can be formed by an opening in the rear wall 114*a* of the appliance 100 that exhausts a portion A200*a*, A200*b* of the air from the cooling air system in an upward direction. The rear exhaust louvers 200*a*, 200*b* are not limited to any particular shape, size, or arrangement. The outlet of the rear exhaust louvers 200*a*, 200*b* can be configured to direct the air A200*a*, A200*b* upward (e.g., vertically or at an angle) from the outlet along an exterior surface of the rear wall 114*a* of the housing 100. One or more of the rear exhaust louvers 200*a*, 200*b* may include a deflector, flange, or the like that directs or deflects the air A200*a*, A200*b* from the outlet along the exterior surface of the rear wall 114*a* of the housing 102. In another example, one or more of the rear exhaust louvers 200*a*, 200*b* can include a deflector, flange, or the like that directs or deflects the air A200*a*, A200*b* from the outlet vertically along an exterior surface of the rear wall 114*a* of the housing 102. In yet another example, one or more of the rear exhaust louvers 200*a*, 200*b* can include a deflector, flange, or the like that directs or deflects the air A200*a*, A200*b* from the outlet of the rear exhaust louver 200*a*, 200*b* at an angle other than a vertical direction.

In one embodiment, the appliance can be configured such that the cooling air system exhausts greater than 50% of the cooling air from the cooling air system through the rear exhaust louvers 200*a*, 200*b* of the appliance 100. That is, the amount of air A200*a*, A200*b* exiting the louvers 200 can be greater than the amount of air A136 exiting the openings 136 in the rear vent trim 120. In another embodiment, the cooling air system can be configured to exhaust less than 50% of the air through the rear exhaust louvers 200*a*, 200*b* of the appliance 100. That is, the amount of air A200*a*, A200*b* exiting the louvers 200*a*, 200*b* can be less than the amount of air A136 exiting the openings 136 in the rear vent trim 120. In yet another embodiment, the cooling air system can be configured to exhaust the same amount of air (e.g., 50%) from the rear exhaust louvers 200*a*, 200*b* of the appliance 100 as the rear vent trim 120. That is, the amount of air A200*a*, A200*b* exiting the louvers 200*a*, 200*b* can be substantially equal to the amount of air A136 exiting the openings 136 in the rear vent trim 120.

With reference to FIGS. 6A-6D, an exemplary embodiment of a rear panel 400, which forms the rear wall 114*a* of the illustrated appliance 100, will now be described.

The rear panel 400 includes a bottom wall 174, side walls 176, and a rear wall 114*a* forming the exterior rear wall of the appliance. The rear panel 400 can include the one or more rear exhaust louvers 200*a*, 200*b* for permitting air to be exhausted from the appliance 100. The rear exhaust louvers 200*a*, 200*b* can be formed in the rear wall 114*a* by stamping the sheet metal of the rear panel 400 or by other suitable means. In other embodiments, the rear exhaust louver 200*a*, 200*b* can be a separate component coupled to an opening formed in the rear wall 114*a*.

In the illustrated embodiment, the rear panel 400 includes one or more metered exhaust channels 502 configured to guide a portion of the cooling air to one or more of the rear exhaust louvers 200*b*, and particularly, to guide a portion of the cooling air toward the sides of the panel 400 such that the cooling air can exit the rear exhaust louvers 200*b* positioned across the width of the rear panel 400. The metered exhaust channels 502 can be formed from sheet metal and cooperate with the inside surface of the rear panel 114*a* to form an air channel. In other embodiments, the metered exhaust channels 502 can be separately formed components forming an air channel extending from an area or cavity 180 close to the outlet of the cooling fan (e.g., in this example, a central area), along the rear wall 114*a*, and to an area toward the side or corner of the rear panel 400 of the appliance 100. The metered exhaust channels 502 are not limited to any particular size, shape, or cross-section for conveying the cooling air from the cooling air system to the rear exhaust louvers and/or corner exhaust vents.

The metered exhaust channel 502 includes one or more airflow metering devices for controlling or limiting airflow from the cavity 180 into the metered exhaust channel 502, or for controlling the airflow within the metered exhaust channel 502. In the illustrated example, the airflow metering device is a metering flange 710 extending at least partially into the opening between the cavity 180 and the metered exhaust channel 502.

Figure 6A:
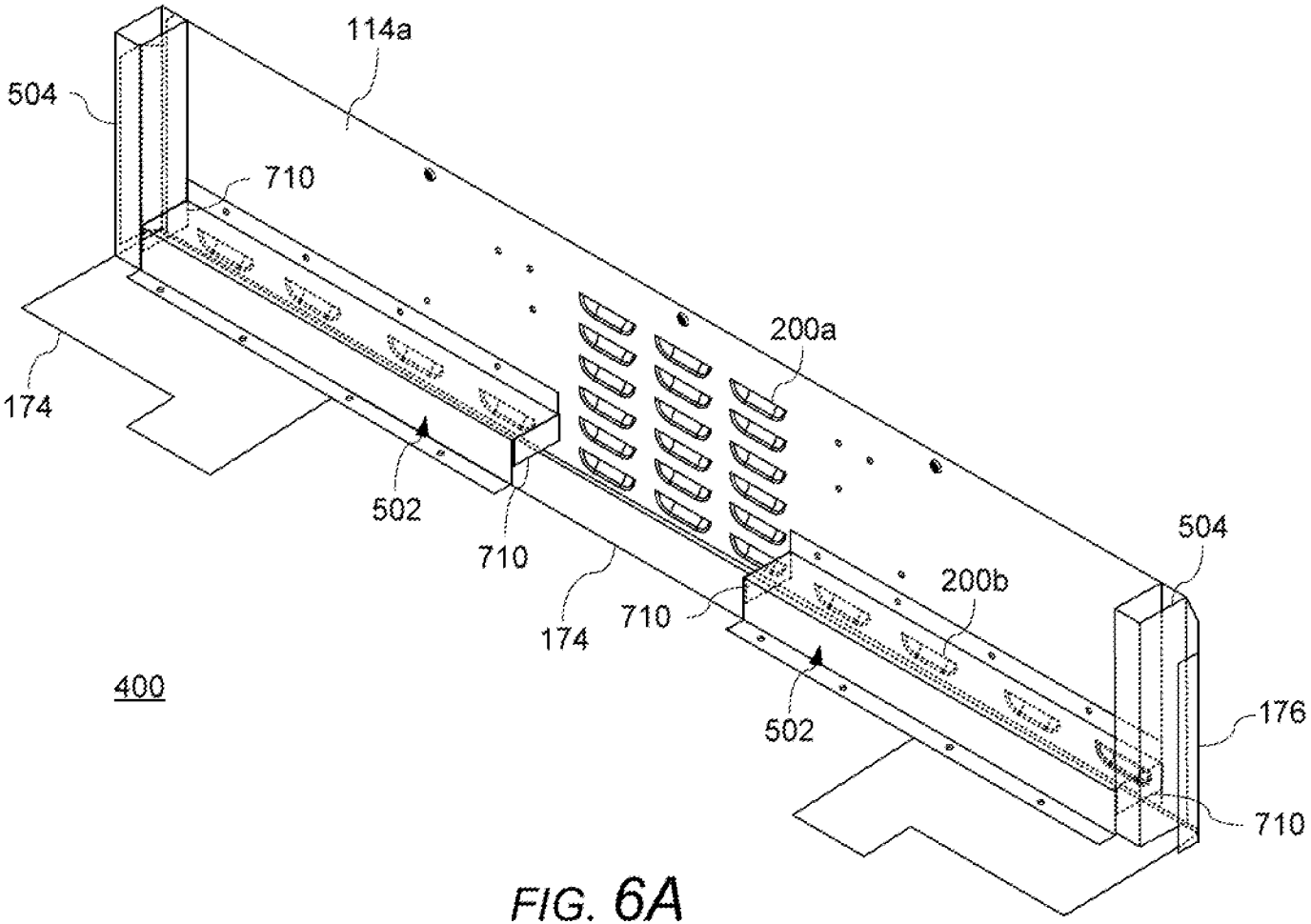
FIG. 6A is a front perspective view of a rear panel of a home cooking appliance having a metered exhaust channel according to an exemplary embodiment of the invention.
Figure 6B:
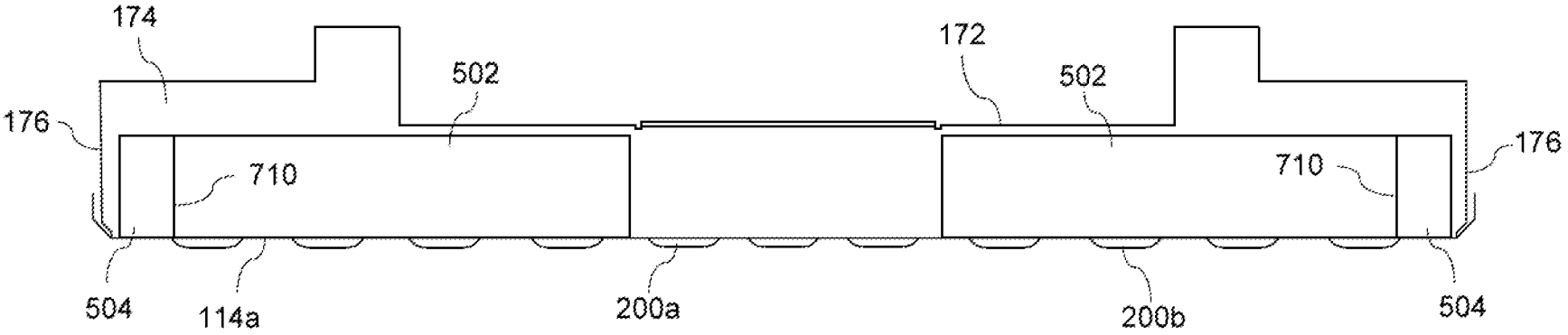
FIG. 6B is a bottom view of the rear panel according to the exemplary embodiment illustrated in FIG. 6A.
Figure 6C:
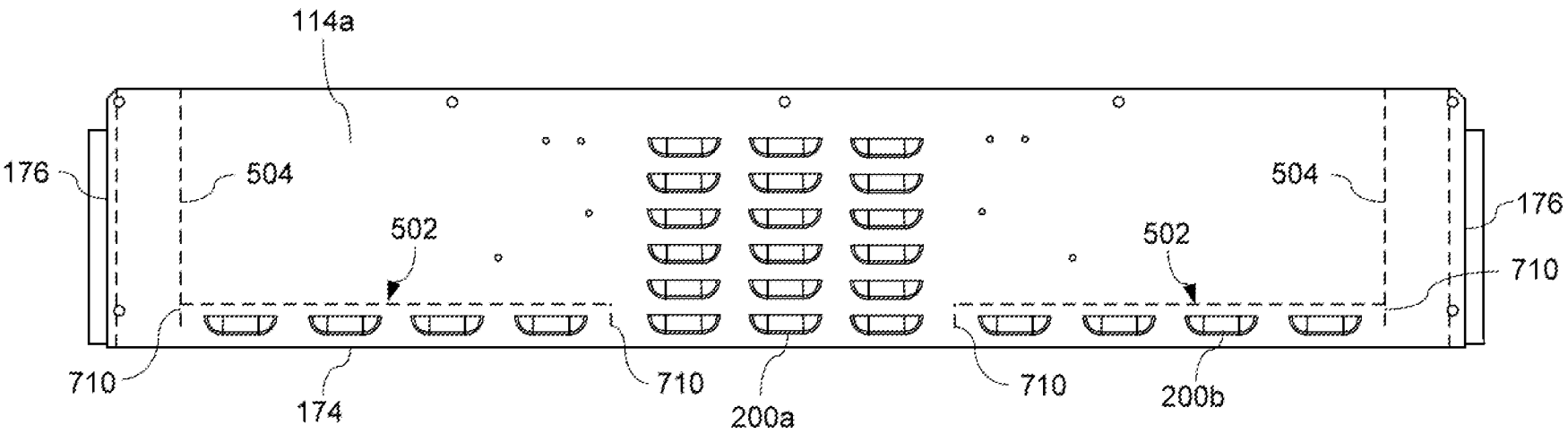
FIG. 6C is a rear view of the rear panel according to the exemplary embodiment illustrated in FIG. 6A.
Figure 6D:
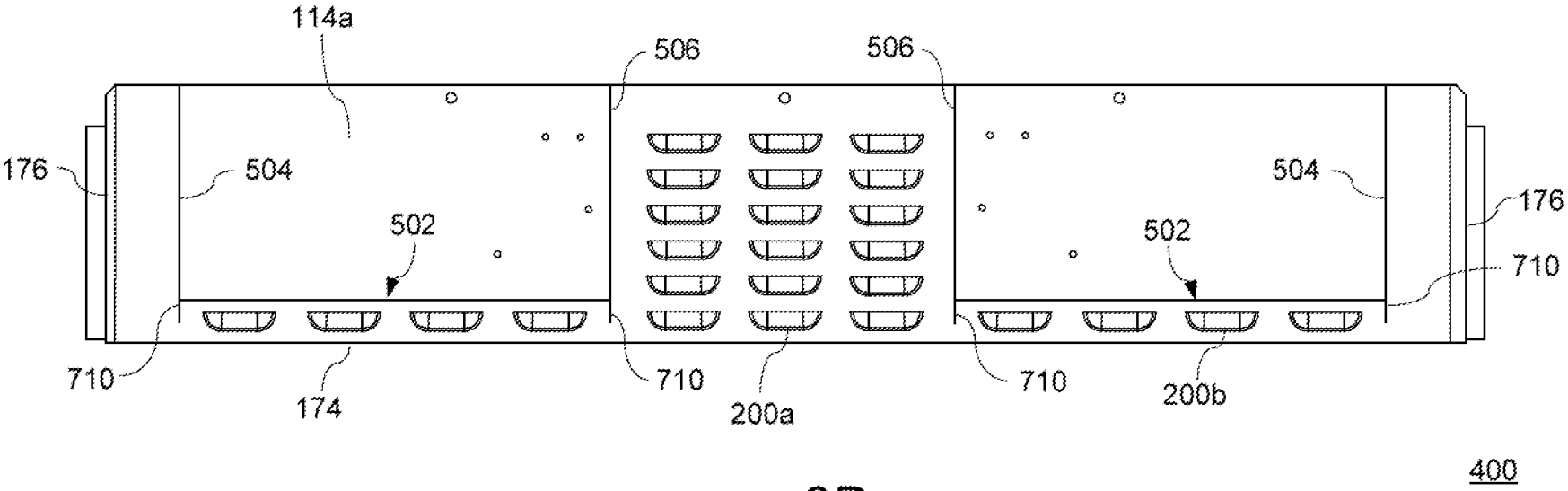
FIG. 6D is a cut-away front view of the rear panel according to the exemplary embodiment illustrated in FIG. 6A.
Figure 6E:
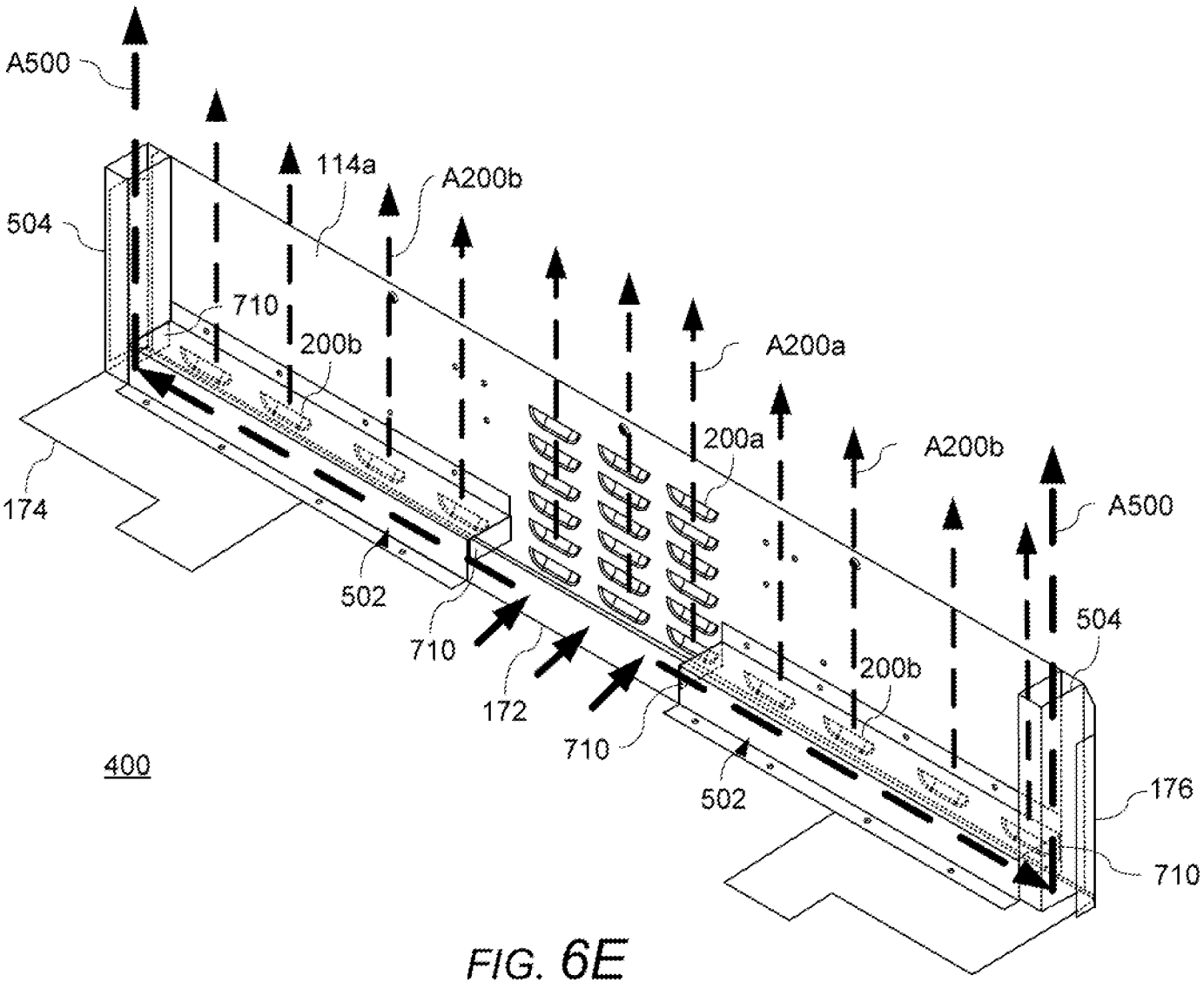
FIG. 6E is a partial rear perspective view of the home cooking appliance illustrated in FIG. 6A, schematically illustrating air flow paths.
Figure 7B:
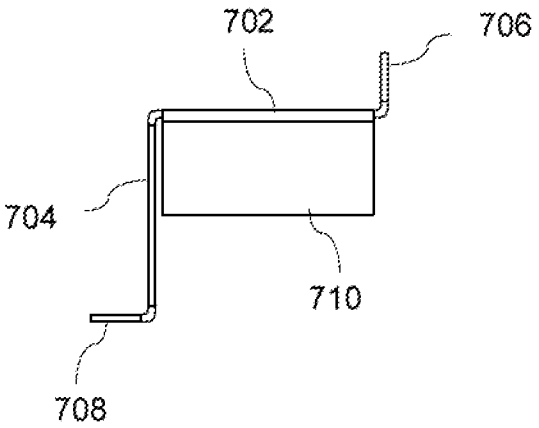
FIG. 7B is a side view of the metered exhaust channel illustrated in FIG. 7A.
Figure 7A:
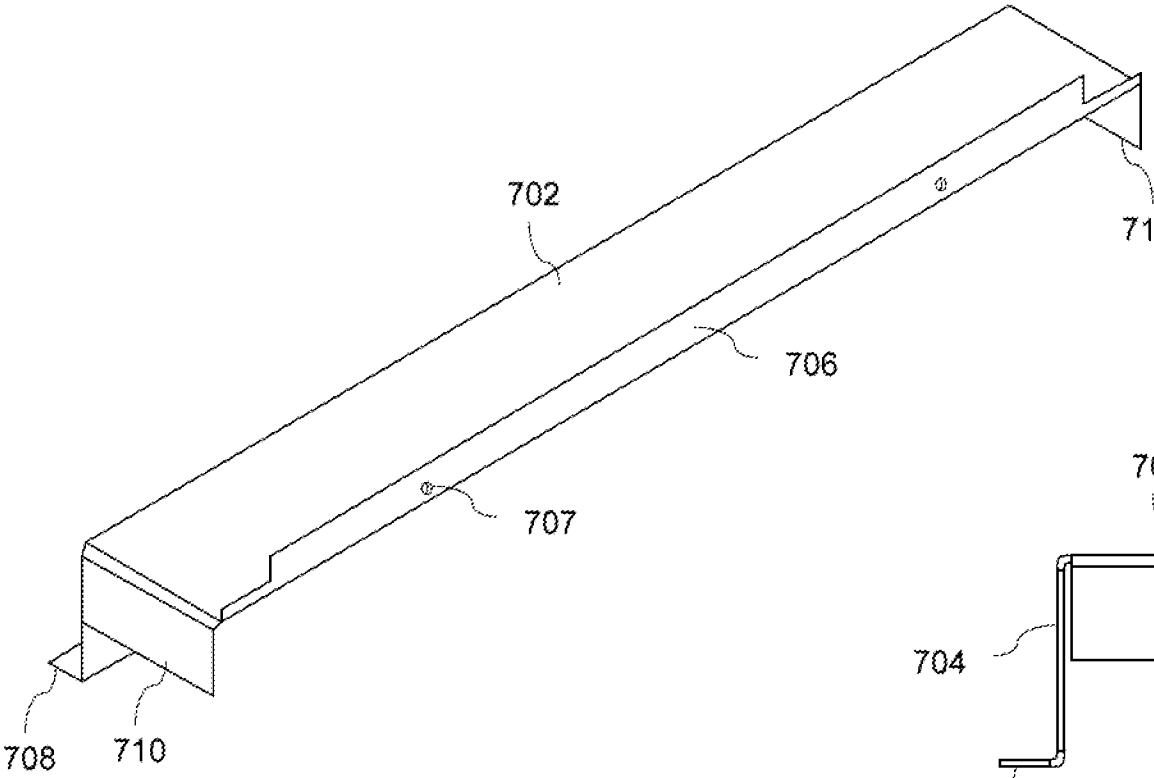
FIG. 7A is a rear perspective view of a metered exhaust channel according to an exemplary embodiment of the invention.
Figure 7C:
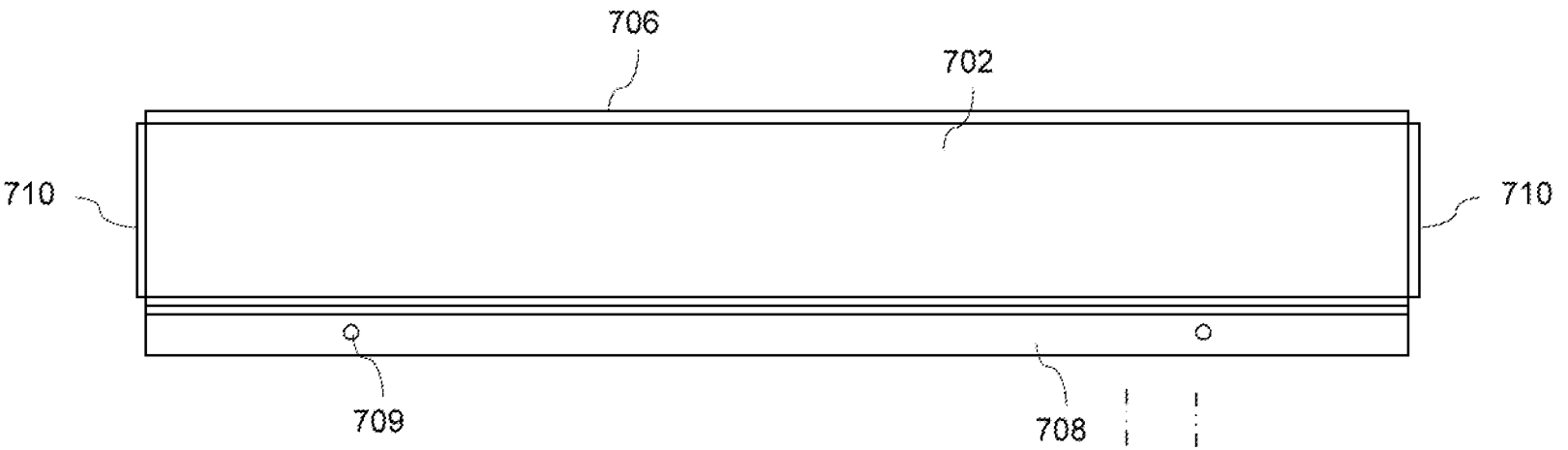
FIG. 7C is a top view of the metered exhaust channel illustrated in FIG. 7A.
Figure 7D:
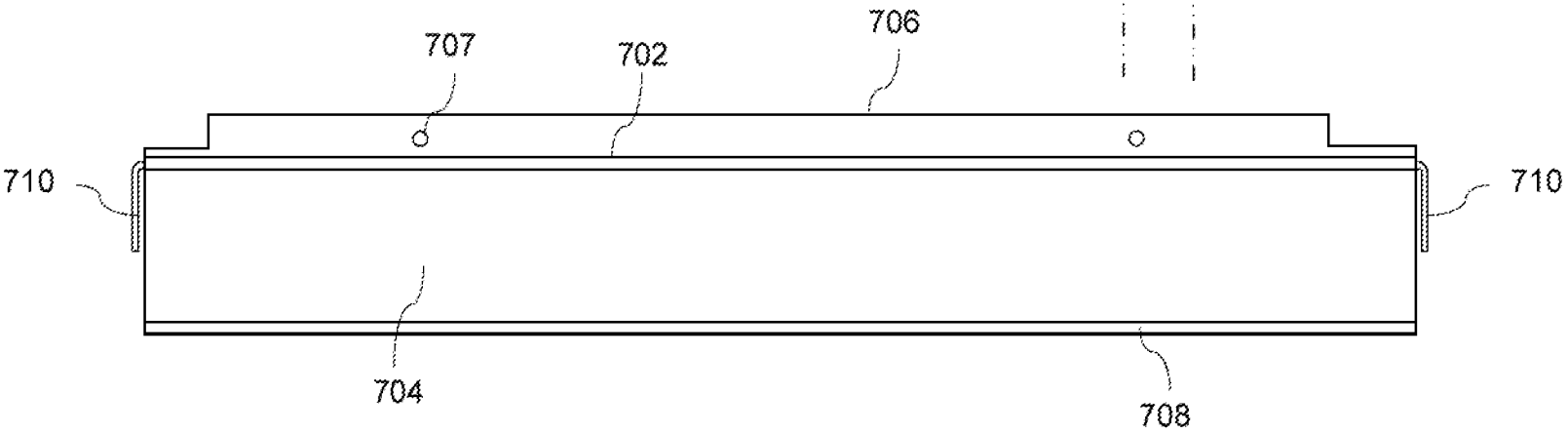
FIG. 7D is a front view of the metered exhaust channel illustrated in FIG. 7A.
Figure 7E:
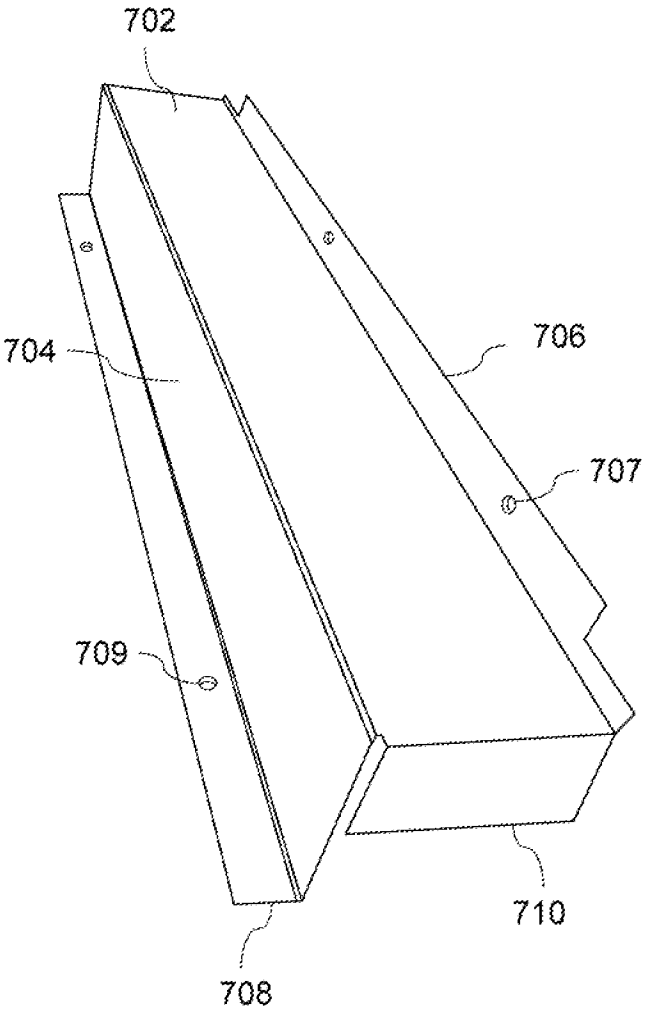
FIG. 7E is a front perspective view of the metered exhaust channel illustrated in FIG. 7A.

As shown in FIG. 6E, in operation, a portion of the cooling air A200*a* exits the rear exhaust louvers 200*a* located in the center of the rear panel 400. Other portions of the cooling air A200*b* flow past or around the airflow metering device (e.g., 710), into each of the metered exhaust channels 502, and exit the rear exhaust louvers 200*b*. The metered exhaust channels 502 are not limited to the illustrated embodiment and can have other shapes, sizes, positions, or arrangements to direct the cooling air to various louver locations. Furthermore, the airflow metering device is not limited to a metering flange 710 and other devices for controlling the airflow can be provided within the spirit and scope of the invention. In addition to, or as an alternative to, guiding the air to the rear exhaust louvers 200*b*, one or more metered exhaust channels 502 can guide a portion of the cooling air to one or more corner exhaust channels 504 located at the sides of the rear panel 400, and the air A500 (shown in FIG. 4F) then can be exhausted from the cooling air system from openings (e.g., 136 in FIGS. 6A-6D described in greater detail below) in the rear vent trim 120, which are disposed over the corner exhaust channels 504 at the corners of the appliance 100. Each metered exhaust channel 502 can guide the air to both the rear exhaust louvers 200*b* and a corner exhaust channel 504, or to only the rear exhaust louvers 200*b* or only a corner exhaust channel 504.

With reference to FIGS. 7A-7F, an exemplary embodiment of a metered exhaust channel 502 will now be described. In this example, the metered exhaust channel 502 includes a top wall 702 and a front wall 704. The metered exhaust channels 502 can be formed from sheet metal and cooperate with the inside surface of the rear panel 114*a* and a bottom wall 174 of the rear panel 400 to form an air channel. The metered exhaust channel 502 can include one more means for coupling the metered exhaust channel to the rear panel (114*a* and/or 114*b*) and/or the bottom wall 174, such as a first mounting flange 706 extending from the top wall 702 and a second mounting flange 708 extending from the front wall 704. The mounting flanges 706 and 708 can include one or more openings, slots, or the like (e.g., 707, 709) to facilitate mounting with a fastener. As shown in the example in FIGS. 7C and 7D, the mounting flanges 706 and 708 and/or the openings 707, 709 can be configured to have a Poke Yoke design in which the metered exhaust channel 502 can be installed on the appliance in only a single orientation, thereby reducing or eliminating assembly errors.

The metered exhaust channel 502 includes one or more airflow metering devices for controlling or limiting airflow into the metered exhaust channel 502 when installed, or for controlling the airflow within the metered exhaust channel 502. In the illustrated example, the airflow metering device is a metering flange 710 extending from the top wall 702 and having a downward bend to position the metering flange 710 in the opening of the end of the metered exhaust channel 502. The metering flange 710 has a 90° bend. However, in other embodiments, the metering flange 710 can be disposed at an angle other than 90° in which the metering flange 710 is positioned in the opening of the end of the metered exhaust channel 502. For example, the flange 710 can be angled, tapered, or curved.

The metering flange 710 can be configured to close or block a predetermined percentage of the area of the end of the exhaust channel 502. In an exemplary embodiment, the flange 710 preferably closes or blocks 50% of the area of the end of the exhaust channel 502. In another embodiment, the flange 710 preferably closes or blocks equal to or less than 75% of the area of the open end of the exhaust channel 502.

Figure 8A:
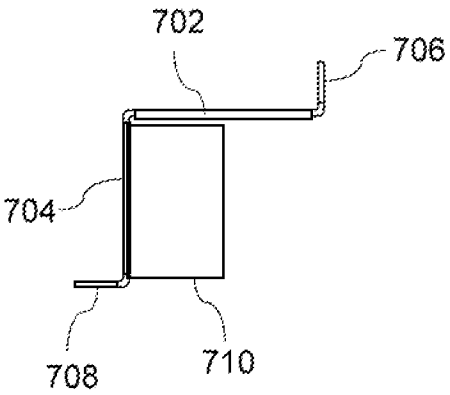
FIG. 8A-8F are side views of a metered exhaust channel according to exemplary embodiments of the invention.
Figure 8B:
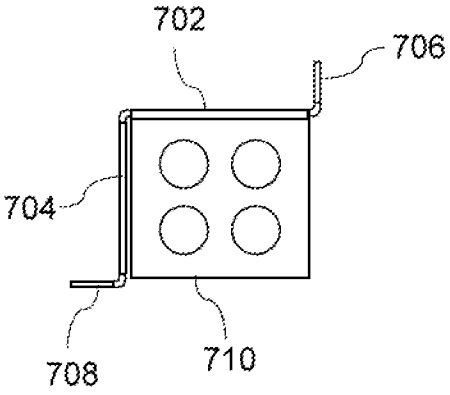
Figure 8C:
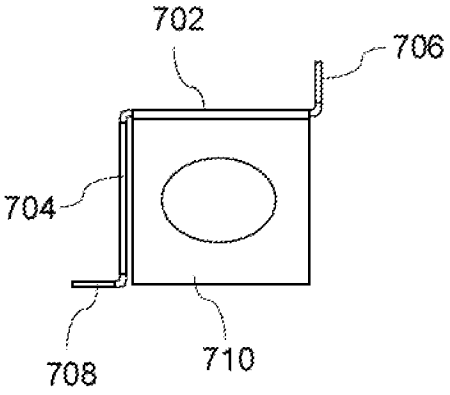
Figure 8D:
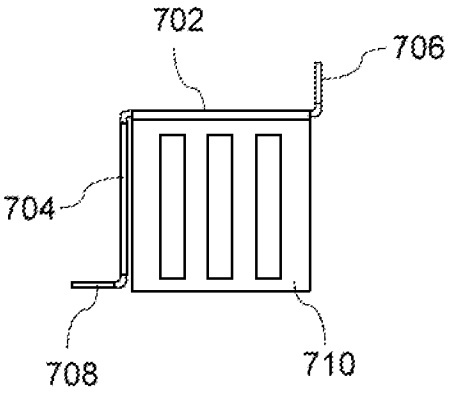
Figure 8E:
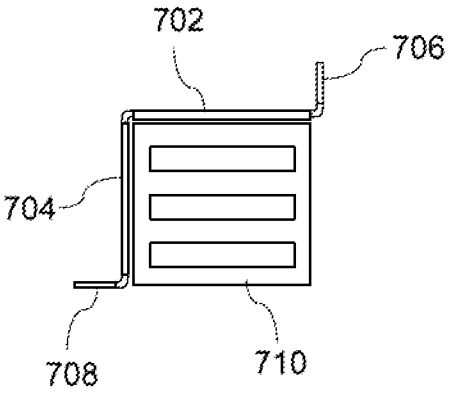
Figure 8F:
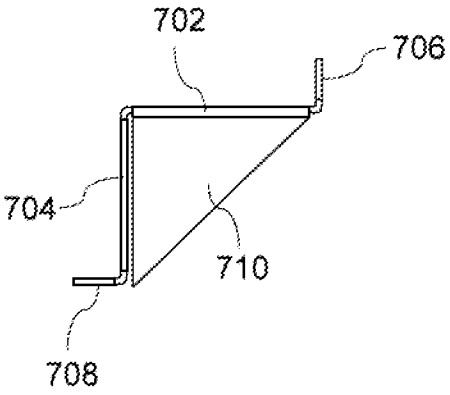

The metering flange 710 can have a rectangular shape, as illustrated in the example of FIGS. 7A-7E. Alternatively, as shown in the examples illustrated in FIG. 8A-8F, the metering flange can have other shapes and/or arrangements. For example, FIG. 8A illustrates an example in which the metering flange extends from the front wall 704 of the metered exhaust channels 502. FIGS. 8B-8E illustrate examples in which the metering flange extends from one or more of the top wall 702 and the front wall 704 and includes one or more openings for permitting air to flow into the metered exhaust channels 502. The openings are not limited to any particular shape and can include, for example, one or more of circular openings, oval openings, rectangular openings, square openings, or another shape opening. FIG. 8F illustrates an example in which the metering flange extends from one of the top wall 702 and the front wall 704 of the metered exhaust channels 502 and includes a triangular shape. The openings can be formed in a two-dimensional plane or have three-dimensional aspects, such as a conical shape (or another shape) stamped into the sheet metal, which may continuously or incrementally reduce the cross-section of the flow path.

With reference again to FIGS. 7A-7E, the metered exhaust channel 502 can include a metering flange 710 at each end. In this way, the metered exhaust channel 502 can be configured to be universally installed on either side of the rear panel 400, thereby simplifying assembly of the metered exhaust channel 502 with the rear panel 400. The number, orientation, and location of the one or more metering flanges 710 on the metered exhaust channel 502 is not limited to the examples shown in FIGS. 7A-7E.

Figure 9A:
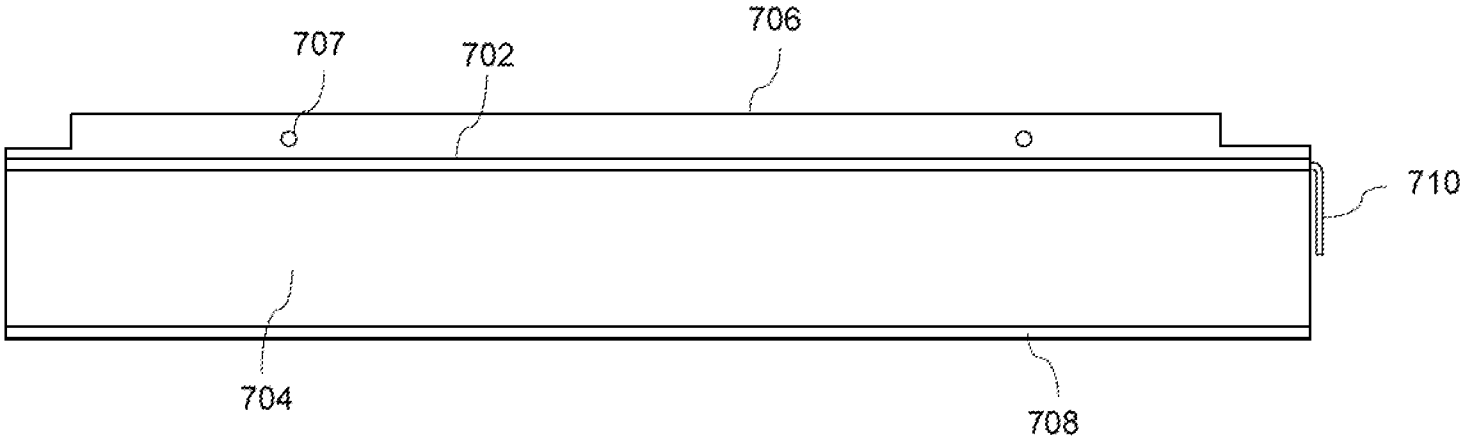
FIG. 9A-9D are front views of a metered exhaust channel according to exemplary embodiments of the invention.
Figure 9B:
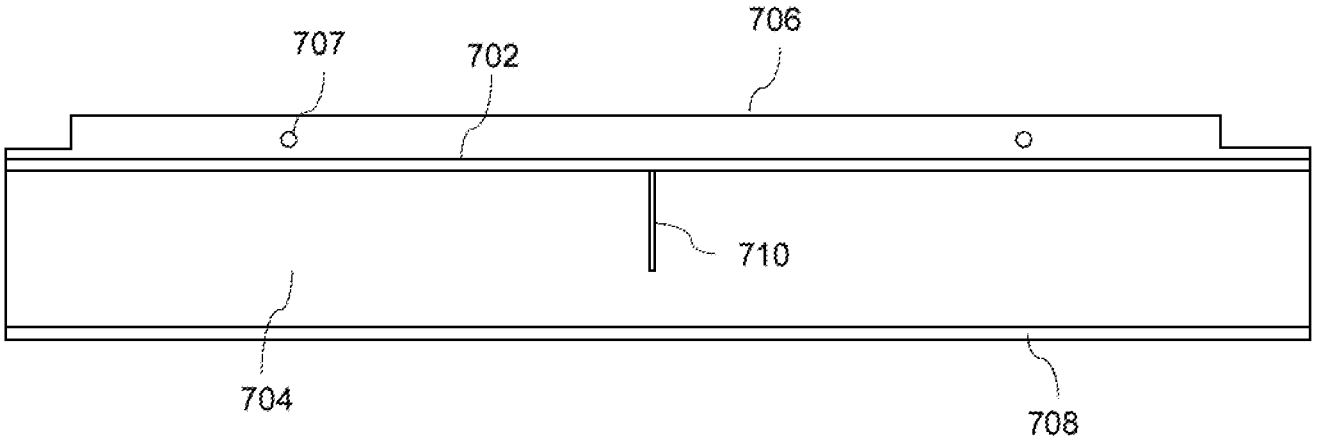
Figure 9C:
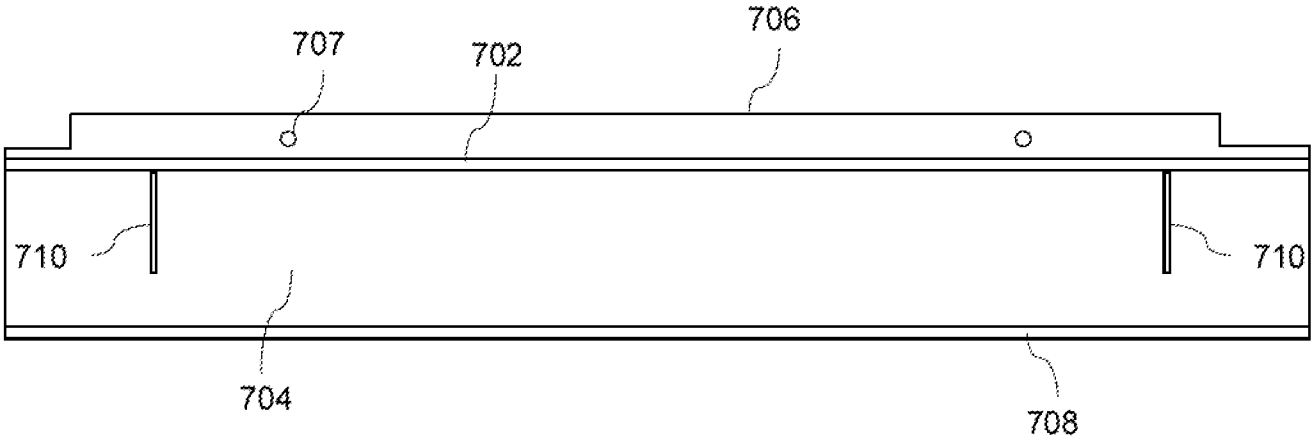
Figure 9D:
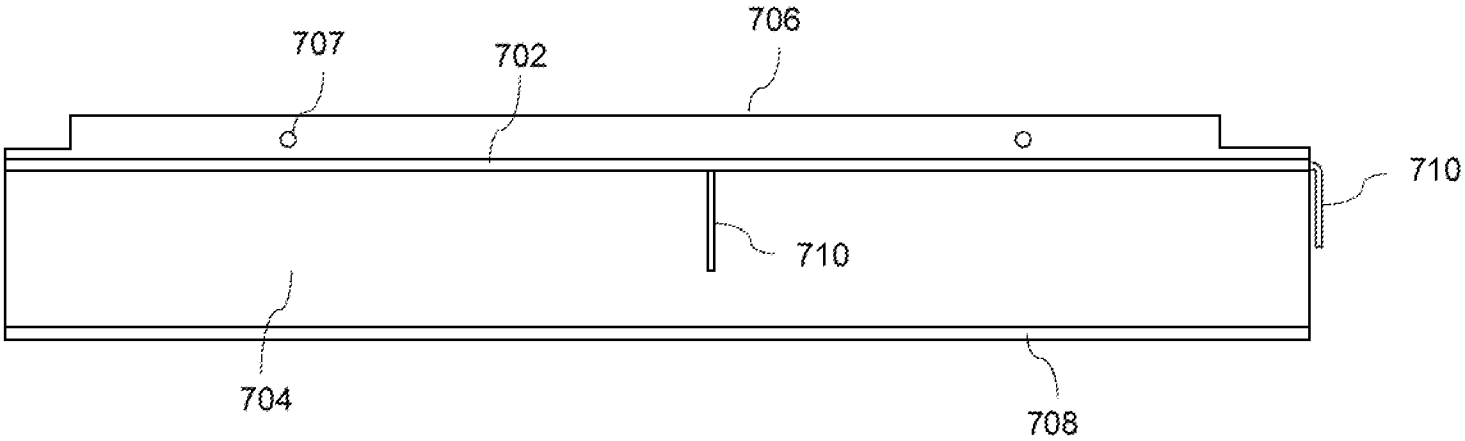

For example, FIG. 9A illustrates an example in which the metered exhaust channel 502 includes a metering flange 710 only at one end. FIG. 9B illustrates an example in which the metered exhaust channel 502 includes a metering flange 710 disposed in the space between longitudinal ends of the metered exhaust channel 502. In this example, the metering flange 710 is centrally disposed in the space between longitudinal ends of the metered exhaust channel 502. However, in other examples, the metering flange 710 can be disposed at one or more locations in the space between longitudinal ends of the metered exhaust channel 502, as shown in FIG. 9C. In other example, the metered exhaust channel 502 can include a plurality of metering flanges 710 in which all of the metering flanges have the same dimensions, shape, and/or orientation, or in which one or more of the plurality of metering flanges has a different dimension, shape, and/or orientation than another of the plurality of metering flanges, as shown in FIG. 9D. For example, a first metered flange can be arranged upstream of a second metered flange, wherein the first metered flange has a smaller dimension (e.g., blocks a smaller percentage of the area of the flow path into or through the metered exhaust channel 502) than the second metered flange arranged downstream of the first metered flange. For example, the plurality of metered flanges can be configured to incrementally increase in size, thereby incrementally reducing an area of the flow path and incrementally controlling the backflow pressure and velocity of the air flow at a number of locations along the flow path, and hence controlling the pressure and velocity of the air A200*b* exiting from different locations of the rear exhaust louvers 200*b*.

Figure 10:
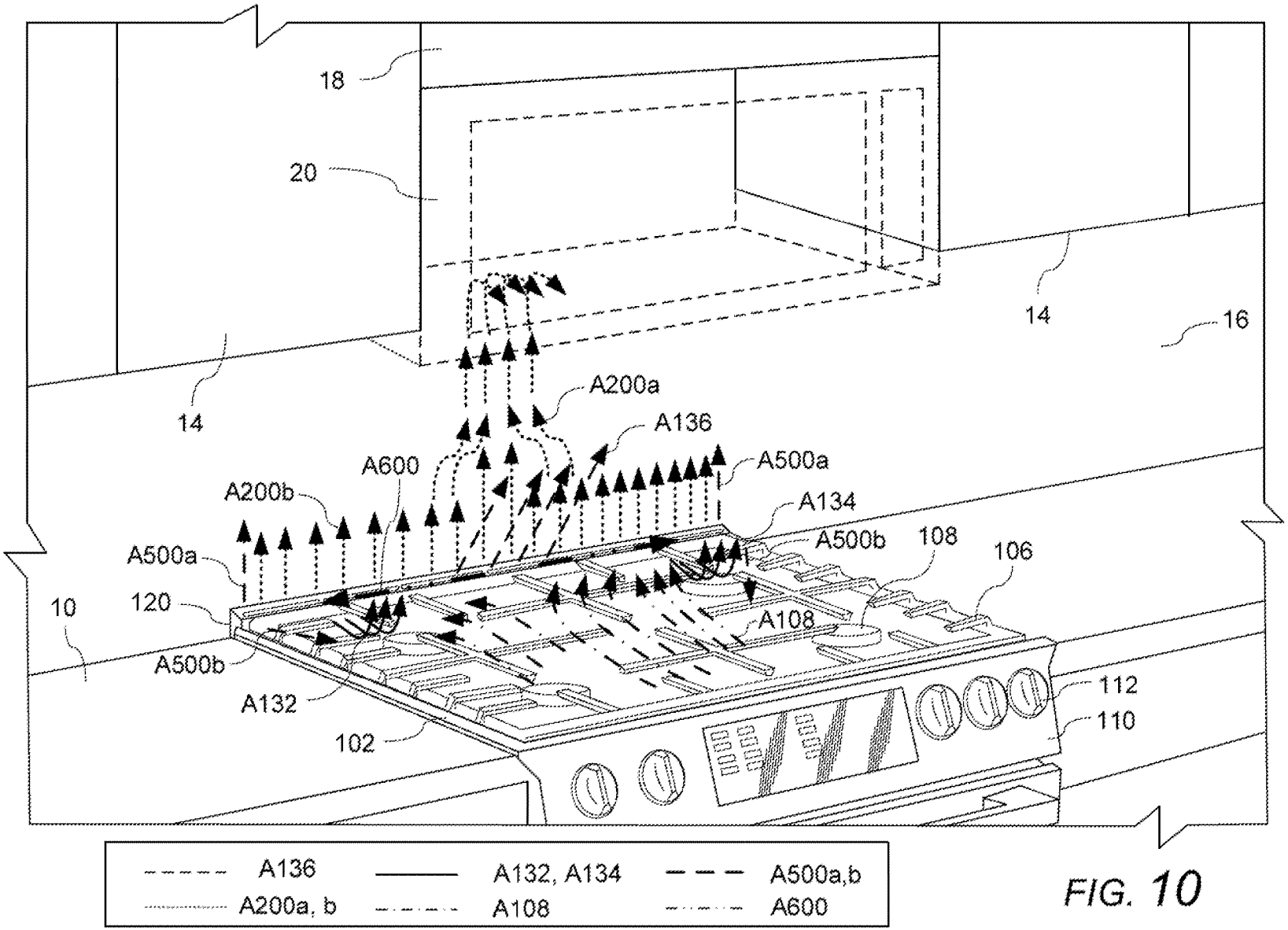
FIG. 10 is a partial, perspective view of a home cooking appliance according to an exemplary embodiment of the invention schematically illustrating air flow patterns.

With reference to FIG. 10, the air flow above the cooktop of an appliance according to the exemplary embodiments of the invention, and the effect on the air flow by various aspects of the exemplary embodiments of the invention, will now be described.

FIG. 10 illustrates air flow characteristics of an exemplary embodiment of a home cooking appliance 100 having a plurality of rear exhaust louvers 200 located, for example, across the width of the appliance 100 and a substantially flush rear vent trim 120 that directs air A136 from the cooling air system forward and away from the back wall 16 of the kitchen (e.g., away from a 90° angle with respect to the upper surface of the cooking surface 106), and more particularly, in a forward direction above the cooking grates 106 of the cooktop such that the air A136 does not disrupt the burner flame even when a burner 108 is on a lowest setting. The plurality of rear exhaust louvers 200*a*, 200*b* direct the air A200*a*, A200*b* in an upward direction along the rear wall 114*a* and substantially in a plane of the rear wall 114*a* such that the air A200*a*, A200*b* flows upward beyond the top of the appliance to increase the air pressure along the back wall 16 of the kitchen and creates an air wash that impedes the flow of the air A136, flue gases A132, A134, and other heated air A108 from the cooktops from flowing or being drawn toward the back wall 16 of the kitchen. In the example, the rear exhaust louvers 200*a*, 200*b* extend across the entire width of the appliance 100, thereby creating a high pressure air wash by the air A200*a*, A200*b* that extends across the entire width of the appliance 100 along the back wall 16 of the kitchen. Moreover, in this example, the appliance 100 optionally includes corner exhaust channels 504 that exhaust air A500*a*, A500*b* from the cooling air system from the openings at the corners of the rear vent trim 120. In this embodiment, the air A500*a* is exhausted in an upward direction from the corners of the rear vent trim 120 and the air A500*b* is exhausted in a forward direction away from the back wall 16 of the kitchen (e.g., away from a 90° angle with respect to the upper surface of the cooking surface 106), thereby creating a high pressure area or air stream by the air A500*a*, A500*b* at each corner of the appliance 100 to impede the flow of hot air toward the corners of the appliance. Furthermore, the openings 136 in the substantially flush rear vent trim 120 are configured to exhaust air A136 along a central portion of the rear vent trim 120 to push the hot air from the flues A132, A134 and cooktop A108 (which is impeded from flowing toward the back wall 16 and the sides of the appliance by the air A200*a*, A200*b* and corner exhaust air A500*a*, A500*b*) forward and away from the back wall 16 of the kitchen.

As shown in FIG. 10, the exemplary embodiments may impede a flow of most, or all, of the hot air toward the back wall 16 and toward the sides of the rear vent trim and adjacent cabinetry (e.g., 10, 14), such that the air A136 from the openings 136 in the substantially flush rear vent trim 120 is sufficient to push the hot air from the flues A132, A134 and cooktop A108 forward and away from the back wall 16 of the kitchen and the corners of the appliance 100, thereby reducing temperatures on the back wall 16 and adjacent cabinetry 14, 18, 20 during operation of the appliance 100. As a result, the present invention can provide an appliance having a substantially flush rear vent trim while providing sufficient control of the air flow around the appliance to comply with industry standards and requirements. The air A200*a*, A200*b* being directed by the plurality of rear exhaust louvers 200*a*, 200*b* in an upward direction along the rear wall 114*a* and substantially in a plane of the rear wall 114*a* is cooled prior to being exhausted from the rear exhaust louvers 200*a*, 200*b* by mixing the cooling air in the cooling air system with cooler air (e.g., A8 in FIG. 4A) drawn in from behind the appliance 100 by one or more fan channels (e.g., 300 in FIG. 4B), thereby maintaining acceptable temperatures along the back wall 16 of the kitchen. Additionally, a temperature of the air A136 being exhausted from the openings 136 in the rear vent trim 120 also can be reduced, which also may reduce air temperatures above the cooktop 106 of the appliance 100.

The present invention, as illustrated for example in FIGS. 1-10, provides an airflow metering device (e.g., 710) that can be configured to control an airflow of the portion of the cooling air flowing at least one of into the exhaust channel 502 and within the exhaust channel 502. By providing one or more airflow metering devices (e.g., flange 710 formed to extend from an existing part) having predetermined sizes, shapes, etc. at one or more locations in the flow path, the present invention can simply and easily control or limit airflow from the cooling air system into the metered exhaust channel 502, and/or control the airflow within the metered exhaust channel 502, thereby affecting air pressure and velocity of the air in the cooling air system upstream of the metered exhaust channel 502 or at locations along the flow path through the metered exhaust channel 502. Accordingly, depending on a variety of factors that can affect the flow of air outside of, or around, the appliance, and/or within the cooling air system of the appliance (such as the addition or altering of parts and/or an arrangement of parts of the appliance; e.g., the use of common side panel parts across different models of appliances), which in turn can affect the temperature at areas of the back wall of the kitchen located behind the appliance, as well as at areas of other components that are adjacent to the appliance, the present invention provides a simple solution for controlling or metering the flow of air (e.g., a velocity and/or pressure of the air) within particular areas of the cooling air system of the appliance and/or for controlling or metering the flow of air (e.g., a velocity and/or pressure of the air) exhausting from particular areas of the appliance that can be simply and easily added to one or more existing parts of the appliance, thereby minimizing modification of existing parts while also allowing common mating parts to be used on multiple types of appliances. For example, one or more airflow metering devices (e.g., 710) can be configured to increase air pressure (e.g., back pressure) in areas of the cooling system upstream of the exhaust channel 502 and decrease air pressure in the exhaust channel 502 or in areas downstream of the exhaust channel 502. In this way, the airflow metering device (e.g., 710) can increase a velocity of cooling air exiting a rear louver (or a plurality of rear louvers) upstream of the exhaust channel 502 (e.g., at a central location of the rear wall of the appliance and back wall behind the appliance) while decreasing a velocity of cooling air exiting a rear louver (or a plurality of rear louvers) along, or downstream of, the exhaust channel 502 (e.g., at locations of the rear wall of the appliance and back wall behind the appliance between the center of the back wall and the sides of the back wall of the appliance). The airflow metering device (e.g., 710) also may increase a volume of cooling air exiting the rear louver (or a plurality of rear louvers) upstream of the exhaust channel 502 (e.g., at a central location of the rear wall of the appliance and back wall behind the appliance) while decreasing a volume of cooling air exiting the rear louver (or a plurality of rear louvers) along, or downstream of, the exhaust channel 502 (e.g., at locations of the rear wall of the appliance and back wall behind the appliance between the center of the back wall and the sides of the back wall of the appliance). The rear exhaust louvers (e.g., 200*a*, 200*b*) direct the air being exhausted from the appliance in an upward direction along the areas of the rear wall and substantially in a plane of the rear wall such that the air flows upward beyond the top of the appliance to increase the air pressure along the back wall of the kitchen and create an air wash that impedes the flow of the air (as well as flue gases and other heated air from the cooktops) from flowing or being drawn toward the back wall of the kitchen, to thereby maintain temperatures of the back wall in compliance with industry standards and regulations.

Other advantages of the invention, including for example a metered exhaust channel 502 in combination with rear exhaust louvers 200*a*, 200*b*, corner exhaust channels 504, and/or a rear vent trim 120, are that these exemplary arrangements do not blow hot air at a user, allow the burners to function effectively even at lowest settings (without nuisance clicking), allow installation of the appliance with an OTR component (such as an OTR microwave), allow installation of the appliance with a combustible rear wall, and maintain safe door temperatures and electronic component temperatures, even during self-clean cycles, particularly when used in combination with other temperature control measures of the exemplary home cooking appliance. By effectively managing and controlling the flow of hot air (e.g., flue gas, cooling air, etc.), the exemplary appliance 100 having a metered exhaust channel 502 in combination with rear exhaust louvers 200*a*, 200*b*, corner exhaust channels 504, and/or a rear vent trim 120 can assist with balancing and optimizing the air flow in the cooling air system, thereby resulting in improved air flow in and around the appliance, which also results in improved baking results for the oven. Moreover, by effectively managing and controlling the flow of hot air, the exemplary appliance having a metered exhaust channel 502 in combination with rear exhaust louvers 200*a*, 200*b*, corner exhaust channels 504, and/or a rear vent trim 120 enables the use of a low-profile rear vent trim having a flush installation with the cooking surface to be used, for example, with a high power cooktop (e.g., 60000 BTU/Hr) having, for example five (5) burners, while complying with industry standards and regulations.

With reference again to FIGS. 1-10, an exemplary embodiment is directed to a home cooking appliance (e.g., 100) comprising a housing (e.g., 102) having at least one rear exhaust exit (e.g., 200*b*), a cooking surface (e.g., 106) on a top of the housing (e.g., 102); a cooking compartment (e.g., 190) in the housing (e.g., 102); a cooling air system (e.g., 180) conveying air (e.g., flow paths of A1, A2, A3, A5, A7, A8, A9) through the housing (e.g., 102); and an exhaust channel (e.g., 502) in fluid communication with the cooling air system (e.g., 180) and the at least one rear exhaust exit (e.g., 200*b*), the exhaust channel (e.g., 502) for guiding a portion of the cooling air (e.g., A200*b*) from the cooling air system (e.g., 180) to the at least one rear exhaust exit (e.g., 200*b*), and an airflow metering device (e.g., 710) configured to control an airflow of the portion of the cooling air flowing at least one of into the exhaust channel (e.g., 502) and within the exhaust channel (e.g., 502).

With reference again to FIGS. 1-10, another exemplary embodiment is directed to a home cooking appliance (e.g., 100) comprising a housing (e.g., 102), a cooking surface (e.g., 106) on a top of the housing (e.g., 102); a cooking compartment (e.g., 190) in the housing (e.g., 102); a cooling air system (e.g., 180) conveying air (e.g., flow paths of A1, A2, A3, A5, A7, A8, A9) through the housing (e.g., 102); exhaust means (e.g., 502) for conveying the portion of the cooling air (e.g., A200*b*) to the at least one rear exhaust outlet (e.g., 200*b*); and means for controlling (e.g., 710) an airflow of the portion of the cooling air (e.g., 200*b*) at least one of into the exhaust means (e.g., 502) and within the exhaust means (e.g., 502).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a rear exhaust outlet;

a cooking surface on top of the housing, the cooking surface having an upper surface;

a cooking compartment in the housing;

a cooling air system that conveys cooling air through the housing;

an exhaust channel in fluid communication with the cooling air system and the rear exhaust outlet, the exhaust channel defining a flow path between the cooling air system and the rear exhaust outlet and guiding a first portion of the cooling air from the cooling air system to the rear exhaust outlet;

an airflow metering device at a location along the flow path and configured to reduce a cross-sectional area of the flow path at the location compared to a cross-sectional area of the flow path of the exhaust channel downstream from the location to control an airflow of the first portion of the cooling air flowing at least one of into the exhaust channel and within the exhaust channel; and a plurality of central rear exhaust louvers in fluid communication with the cooling air system, the plurality of central rear exhaust louvers being disposed on a central portion of a rear wall of the housing upstream of the exhaust channel and the airflow metering device, the plurality of central rear exhaust louvers exhausting a second portion of the cooling air from the cooling air system in an upward direction substantially in a plane of the rear wall of the housing along a kitchen wall adjacent to the central portion of the rear wall of the housing, wherein the airflow metering device is configured to decrease a first velocity of the first portion of the cooling air flowing downstream of the airflow metering device and exiting the cooling air system from the rear exhaust outlet and increase a second velocity of the second portion of the cooling air flowing upstream of the airflow metering device and exiting the cooling air system from the plurality of central rear exhaust louvers such that the second velocity of the second portion of the cooling air exiting the cooling air system from the plurality of central rear exhaust louvers along the kitchen wall adjacent to the central portion of the rear wall of the housing is greater than the first velocity of the first portion of the cooling air exiting the cooling air system from the rear exhaust outlet.

2. The home cooking appliance of claim 1, wherein the exhaust channel includes an entry opening at a first end in fluid communication with the cooling air system, and wherein the airflow metering device is disposed at the entry opening.

3. The home cooking appliance of claim 1, wherein the exhaust channel includes an entry opening at a first end in fluid communication with the cooling air system, and wherein the airflow metering device is disposed downstream of the entry opening.

4. The home cooking appliance of claim 1, wherein the exhaust channel includes an entry opening at a first end in fluid communication with the cooling air system and an exit opening at a second end, and wherein the airflow metering device includes a first airflow metering device disposed at the first end and a second airflow metering device disposed at the second end.

5. The home cooking appliance of claim 1, wherein the exhaust channel includes an entry opening at a first end in fluid communication with the cooling air system and an exit opening at a second end, and wherein the airflow metering device includes a first airflow metering device and a second airflow metering device, wherein the first airflow metering device and the second airflow metering device are symmetrically arranged with respect to the first end and second end of the exhaust channel.

6. The home cooking appliance of claim 1, wherein the airflow metering device includes a flange extending into the flow path of the portion of the cooling air flowing at least one of into the exhaust channel and through the exhaust channel.

7. The home cooking appliance of claim 6, wherein the flange is integrally formed with the exhaust channel.

8. The home cooking appliance of claim 6, wherein the flange includes at least one opening permitting a portion of the airflow to flow through the flange.

9. The home cooking appliance of claim 8, wherein the flange includes a surface extending from the at least one opening, wherein the surface one of continuously and incrementally reduces a cross-sectional area of the airflow through the opening in the flange.

10. The home cooking appliance of claim 1, wherein the rear exhaust outlet includes a plurality of rear exhaust louvers in fluid communication with the exhaust channel, the plurality of rear exhaust louvers being disposed on the rear wall of the housing and exhausting the portion of the cooling air from the cooling air system in the upward direction substantially in the plane of the rear wall of the housing to increase air pressure along the kitchen wall adjacent to the rear wall of the housing.

11. The home cooking appliance of claim 1, wherein the exhaust channel extends in a horizontal direction adjacent to the rear wall of the housing.

12. The home cooking appliance of claim 1, wherein the home cooking appliance further comprises:

a rear vent trim on the top of the housing and at a rear side of the top of the housing, the rear vent trim having an upper surface that is substantially flush with the upper surface of the cooking surface, the rear vent trim including a plurality of openings permitting additional air to exit from the housing from the rear vent trim, and the rear vent trim directing the additional air away from a 90° angle with respect to the upper surface of the cooking surface.

13. The home cooking appliance of claim 1, wherein the airflow metering device is configured such that a first air pressure upstream of the airflow metering device is greater than a second air pressure in the exhaust channel downstream of the airflow metering device.

14. The home cooking appliance of claim 1, wherein the home cooking appliance further comprises:

a second exhaust outlet for exhausting a second portion of cooling air from the cooling air system out of the housing; and a cavity in fluid communication with the cooling air system, the second exhaust outlet, and the exhaust channel, wherein the airflow metering device is disposed downstream of the cavity.

15. The home cooking appliance of claim 14, wherein the airflow metering device is configured such that a first air pressure in the cavity is greater than a second air pressure in the exhaust channel.

16. The home cooking appliance of claim 14, wherein the rear exhaust outlet includes a plurality of first rear exhaust louvers in fluid communication with the exhaust channel, the plurality of first rear exhaust louvers being disposed on the rear wall of the housing and exhausting the portion of the cooling air from the cooling air system in the upward direction substantially in the plane of the rear wall of the housing to increase air pressure along the kitchen wall adjacent to the rear wall of the housing, and wherein the second exhaust outlet includes a plurality of second rear exhaust louvers in fluid communication with the cavity, the plurality of second rear exhaust louvers being disposed on the rear wall of the housing and exhausting the second portion of the cooling air from the cooling air system in an upward direction substantially in the plane of the rear wall of the housing to increase air pressure along the kitchen wall adjacent to the rear wall of the housing.

17. The home cooking appliance of claim 16, wherein the plurality of second rear exhaust louvers is centrally disposed on the rear wall of the housing with respect to a width of the housing, and wherein the plurality of first rear exhaust louvers is disposed on the rear wall of the housing between a side edge of the rear wall of the housing and the plurality of second rear exhaust louvers.

18. The home cooking appliance of claim 1, wherein the exhaust channel includes at least one wall, and wherein the airflow metering device includes a flange extending from the at least one wall into the flow path of the portion of the cooling air flowing at least one of into the exhaust channel and through the exhaust channel.

19. The home cooking appliance of claim 18, wherein the flange is perpendicular to the at least one wall.

20. The home cooking appliance of claim 18, wherein the flange is disposed at an angle other than perpendicular to the at least one wall.

21. A home cooking appliance comprising:

a housing having a rear exhaust outlet;

a cooking surface on top of the housing, the cooking surface having an upper surface;

a cooking compartment in the housing;

a cooling air system that conveys cooling air through the housing;

an exhaust channel in fluid communication with the cooling air system and the rear exhaust outlet, the exhaust channel for conveying a first portion of the cooling air to the rear exhaust outlet;

means for controlling an airflow of the first portion of the cooling air at least one of into the exhaust channel and within the exhaust channel, the means for controlling being disposed at a location along the flow path and configured to reduce a cross-sectional area of the flow path at the location compared to a cross-sectional area of the flow path of the exhaust channel downstream from the location; and a plurality of central rear exhaust louvers in fluid communication with the cooling air system, the plurality of central rear exhaust louvers being disposed on a central portion of a rear wall of the housing upstream of the exhaust channel and the means for controlling, the plurality of central rear exhaust louvers exhausting a second portion of the cooling air from the cooling air system in an upward direction substantially in a plane of the rear wall of the housing along a kitchen wall adjacent to the central portion of the rear wall of the housing, wherein the means for controlling is configured to decrease a first velocity of the first portion of the cooling air flowing downstream of the means for controlling and exiting the cooling air system from the rear exhaust outlet and increase a second velocity of the second portion of the cooling air flowing upstream of the means for controlling and exiting the cooling air system from the plurality of central rear exhaust louvers such that the second velocity of the second portion of the cooling air exiting the cooling air system from the plurality of central rear exhaust louvers along the kitchen wall adjacent to the central portion of the rear wall of the housing is greater than the first velocity of the first portion of the cooling air exiting the cooling air system from the rear exhaust outlet.

* * * * *